US005378057A

United States Patent [19]

Bach et al.

[11] Patent Number: 5,378,057

[45] Date of Patent: Jan. 3, 1995

[54] METAL CASE

[75] Inventors: David F. Bach, Walker; William K. Hofman, Coopersville, both of Mich.

[73] Assignee: Westinghouse Electric Corporation, Pittsburgh, Pa.

[21] Appl. No.: 891,353

[22] Filed: May 29, 1992

[51] Int. Cl.[6] ..... A47B 43/00

[52] U.S. Cl. ..... 312/257.1; 312/334.4

[58] Field of Search ..... 312/406, 257.1, 265.4, 312/330.1, 334.4; 49/25, 193

[56] References Cited

U.S. PATENT DOCUMENTS

| | | | |
|---|---|---|---|
| 1,046,488 | 12/1912 | Pauley | 312/257.1 |
| 1,729,475 | 9/1929 | Brainard et al. . | |
| 2,072,446 | 3/1937 | Forsthoefel | 62/89 |
| 2,112,498 | 12/1938 | Lax | 312/146 |
| 2,127,212 | 8/1938 | Geddes | 312/172 |
| 2,620,251 | 12/1952 | Restivo . | |
| 2,704,237 | 3/1955 | Nave | 312/323 |
| 2,959,715 | 11/1960 | Leonchick | 317/99 |
| 3,272,581 | 9/1966 | Stucki . | |
| 3,285,684 | 11/1966 | Duncan . | |
| 3,410,621 | 11/1968 | Schreyer . | |
| 3,623,784 | 11/1971 | Neufeld . | |
| 3,664,716 | 5/1972 | Johnson . | |
| 3,771,849 | 11/1973 | Barber . | |
| 3,779,623 | 12/1973 | Motohashi | 312/257 |
| 3,810,430 | 5/1974 | Siegal | 108/144 |
| 3,870,388 | 3/1975 | Lofgren | 312/257 |
| 3,995,922 | 12/1976 | Ohashi | 312/257 |
| 4,005,919 | 2/1977 | Hoge et al. | 312/214 |
| 4,114,065 | 9/1978 | Horvay | 312/214 |
| 4,303,286 | 12/1981 | McClellan | 312/214 |
| 4,378,137 | 3/1983 | Gibson et al. . | |
| 4,387,942 | 6/1983 | Lense . | |
| 4,440,455 | 4/1984 | Lanting et al. . | |
| 4,782,972 | 11/1988 | Wenkman et al. | 220/4 F |
| 4,822,117 | 4/1989 | Boston, Jr. | 312/214 |
| 5,031,974 | 7/1991 | Feucht et al. | 312/263 |
| 5,102,210 | 4/1992 | Beals | 312/330.1 |
| 5,221,136 | 6/1993 | Hauck et al. | 312/406 |
| 5,238,137 | 8/1993 | Cornwall | 220/327 |
| 5,246,286 | 9/1993 | Huebschen et al. | 312/263 |

FOREIGN PATENT DOCUMENTS

| | | | |
|---|---|---|---|
| 167306 | 3/1956 | Australia . | |
| 2365310 | 5/1978 | France . | |
| 607016 | 7/1960 | Italy . | |
| 50454 | 12/1960 | Netherlands . | |
| 88473 | 10/1956 | Norway . | |
| 159299 | 6/1957 | Sweden . | |
| 214601 | 8/1967 | Sweden . | |
| 151257 | 12/1931 | Switzerland | 312/334.4 |
| 178984 | 5/1922 | United Kingdom | 108/110 |
| 840855 | 7/1960 | United Kingdom . | |
| 960363 | 6/1964 | United Kingdom . | |
| 988296 | 4/1965 | United Kingdom . | |

*Primary Examiner*—Kenneth J. Dorner
*Assistant Examiner*—Gerald A. Anderson
*Attorney, Agent, or Firm*—Carla J. Vrsansky

[57] ABSTRACT

A metal case having an adaptable capability between a lateral file or a cabinet which includes an inner framework comprised of a plurality of corrugated metal panels, each having a similar cross-sectional configuration and substantially extending the depth and length of the case. The panels are arranged horizontally and vertically to form a box-like structure which may be encased in a one-piece, metal outer wrapper and finished with a top and a base pan, thereby concealing spot welds which partially secure the inner framework to the outer wrapper. The inner framework is further secured to the outer wrapper by adhesive, which also provides acoustical insulation. The vertical panels include equidistantly placed, symmetrically arranged openings which may accommodate either self-locating, snap-in door hinges for a storage cabinet embodiment or unhanded, snap-in drawer glides for a lateral file embodiment.

13 Claims, 24 Drawing Sheets

METAL CASE

CROSS REFERENCE TO COPENDING APPLICATION

This application is related to copending U.S. Ser. No. 07/872,476, filed Apr. 23, 1992 and assigned to the same assignee as this application.

BACKGROUND OF THE INVENTION

1. Field of the Invention

This invention relates to a metal case and, more particularly to a metal case adaptable to a lateral file or a cabinet having snap-in drawer glide and door hinge attachments, thereby providing a cost effective case construction having minimal parts and tooling requirements.

2. Description of the Related Art

Modern office or industrial environments require increasing storage capabilities including storage cabinets and lateral filing systems that can be multi-functional, easily interchangeable and sturdy, but also attractive and inexpensive in order to adapt to the many styles of office design.

Metal cases including storage cabinets, filing cabinets and the like are well known in the art. Cases are also known in the art that have a convertible capability between file cabinets with drawers and storage cabinets with doors. Most are constructed using an interior skeletal frame including vertical rails or channels and horizontal cross bars. However, these interior skeletal frames, which support only an exterior skin, do not provide sufficient sturdiness to prevent a tinny, hollow sound when drawers or cabinet doors are opened or closed.

Other cabinets, particularly wood kitchen cabinets, include interior vertical partition walls having apertures to accommodate shelf brackets. While metal office cabinets generally do not include interior partition walls which could provide more structural stability, there have been instances of lateral filing cabinets which include an inner side panel construction with flanged side edges which attempt to solve the sturdiness problem, but which are more costly to manufacture because of the increased need for additional thicker gauged metal to provide a double wall construction.

With regard to drawer and cabinet door attachments, cabinets or cases are known to include drawer suspension systems having a single structural glide channel which is attached by screws, nuts and bolts to both interior sides of the cabinet as well as to both sides of the drawer. Other cases are known to include drawer-glide devices having oppositely-disposed rails operably interconnected by ball rollers wherein one rail is fixedly attached to the side of the drawer, while the opposite rail is removably attached to the inner cabinet frame by means of bayonet clips formed as an integral part of the removable rail. Other drawer glide assemblies include a center drawer glide having an upper member secured to the bottom of the drawer by clips and tabs and a lower member secured to the cabinet frame by screws.

There are also known drawer cabinets having mounting tabs prewelded to the cabinet interior side walls so that drawer glide mounting systems may be attached to the cabinet interior by a simple key and keyslot locking system.

Door hinges are also well known in the art. For example, wood kitchen cabinets employ door hinges having a standard mounting base and an adjustable plate secured to the flat, solid wood surface of the inside of the kitchen cabinet. However, a common problem referred to as door sag eventually occurs after prolonged opening and closing of the doors as a result of the force and twist applied to the door by one leaning on the open end of the door.

Consequently, there exists a need to provide an attractive, yet sturdy, high quality metal case having an adaptable capability between a lateral file and a storage cabinet which includes an interior box-like inner framework having panels with openings therein which are equidistantly placed and symmetrically arranged to accommodate unhanded, snap-in drawer glides and door hinge attachments that is cost effective and does not require excess hardware or parts that can be easily misplaced.

SUMMARY OF THE INVENTION

A metal case having an adaptable capability between a lateral file and a cabinet which includes an inner framework comprised of a plurality of corrugated metal panels, each having a similar cross-sectional configuration and substantially extending the complete depth and length of the case. The panels are arranged horizontally and vertically to form a box-like structure which is encased in a one-piece, metal outer wrapper and finished with a top and a base pan, thereby concealing spot welds which partially secure the inner framework to the outer wrapper. The inner framework is further secured to the outer wrapper by adhesive, which also provides acoustical insulation. The vertical panels include equidistantly spaced, symmetrically arranged openings which may accommodate either self-locating, snap-in door hinges for a storage cabinet embodiment or unhanded, snap-in drawer glides for a lateral file embodiment.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The metal case described herein is capable of being adapted to a cabinet or a lateral file which includes an inner box-shaped framework constructed of similarly configured metal corrugated panels which substantially extend the complete depth and length of a side of the case. The side panels of the inner framework include openings which accommodate unhanded drawer glides having both a snap-in capability and a load-bearing capacity if a lateral file with drawers is desired or self-locating door hinge attachments if a storage cabinet embodiment is desired. The inner framework may be encased in a one-piece metal outer wrapper as well as a top and bottom pan, thereby providing a double wall thickness of the entire top, sides and bottom of the metal case.

Figure 1:
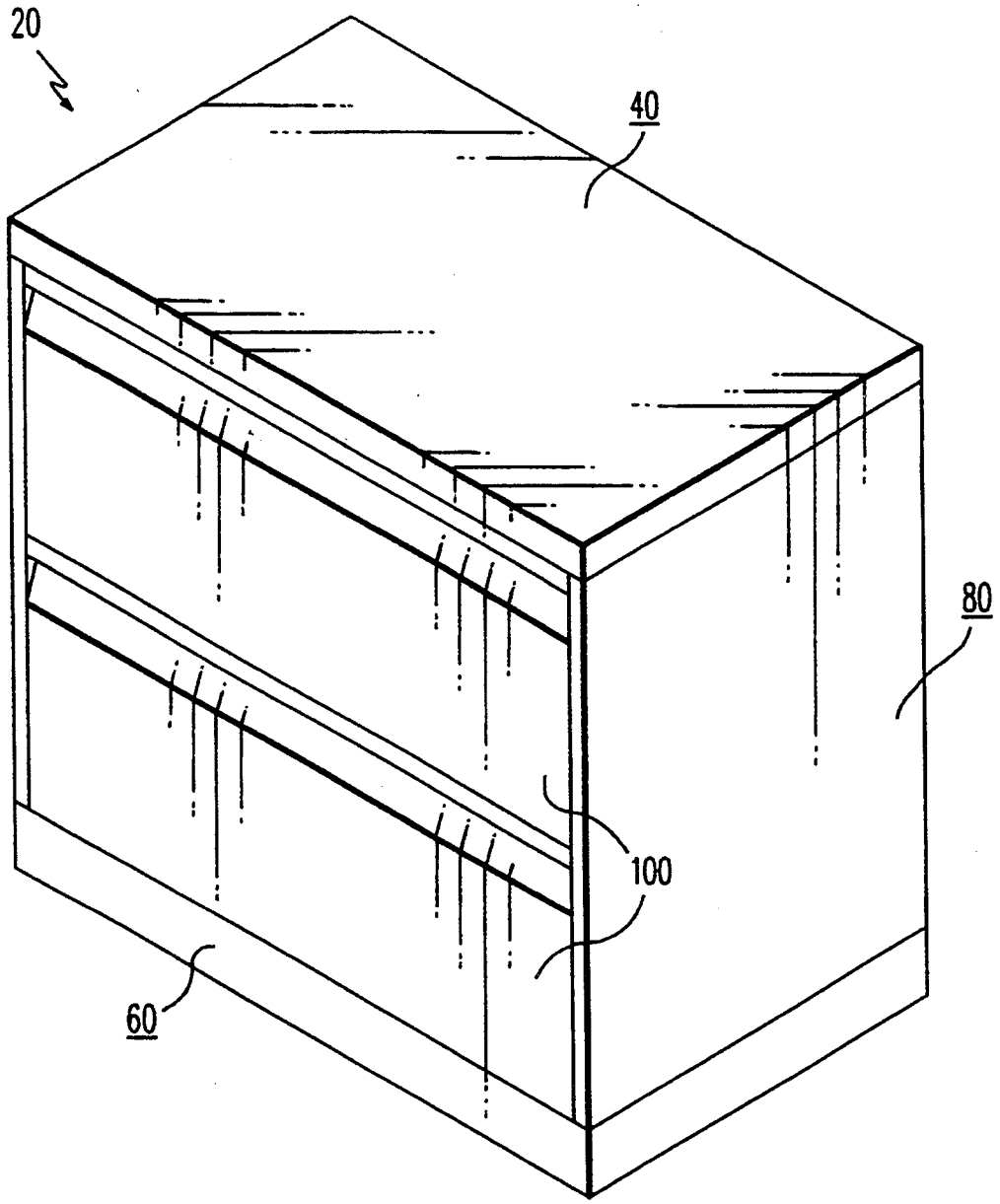
FIG. 1 a perspective view of the exterior of the metal case, in this instance, a lateral file with drawers.
Figure 2:
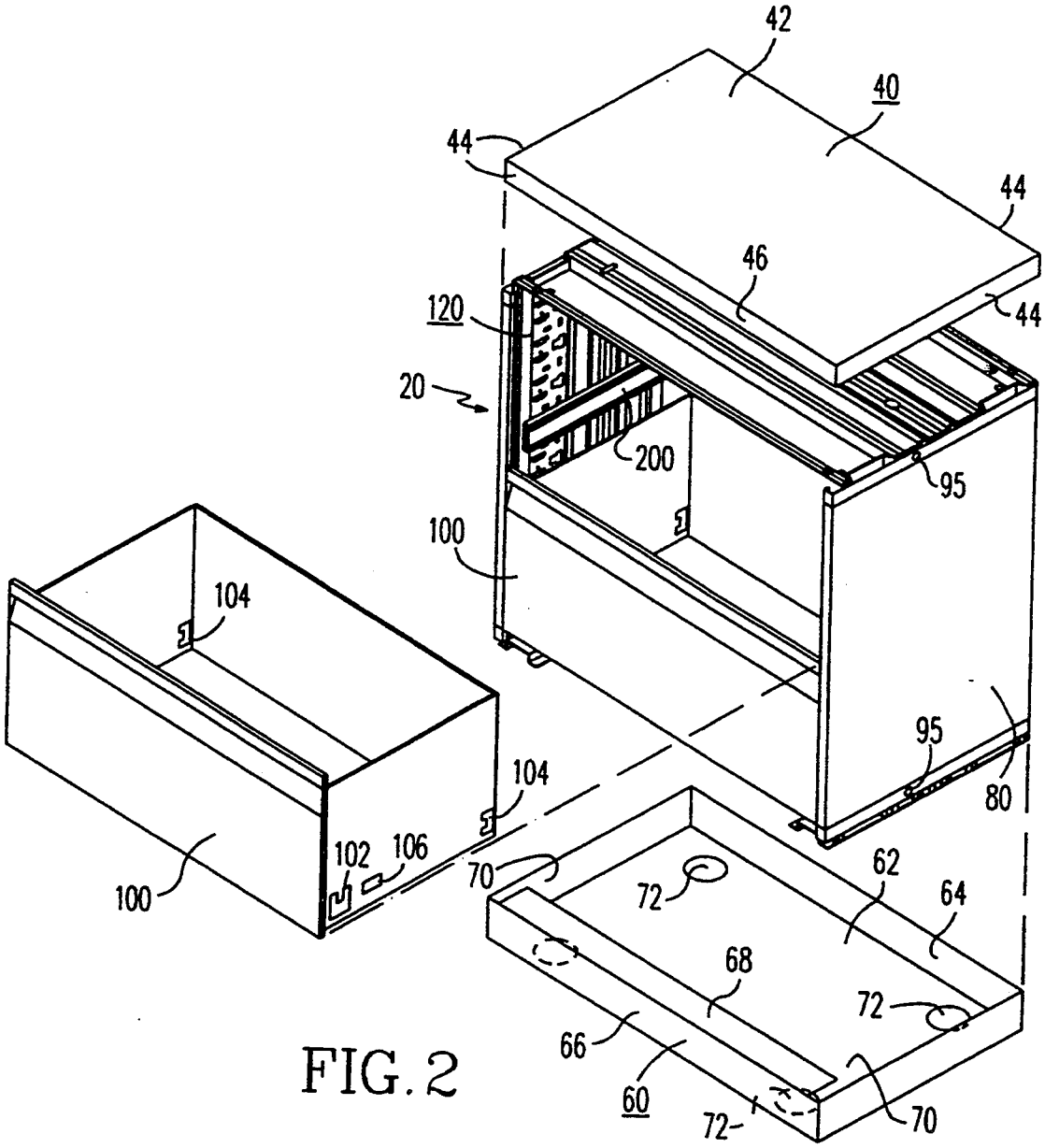
FIG. 2 is a partially exploded perspective view of the case illustrating the outer wrapper attached to the inner framework with the top pan, bottom pan, and one of the drawers exploded away for clarity.
Figure 3:
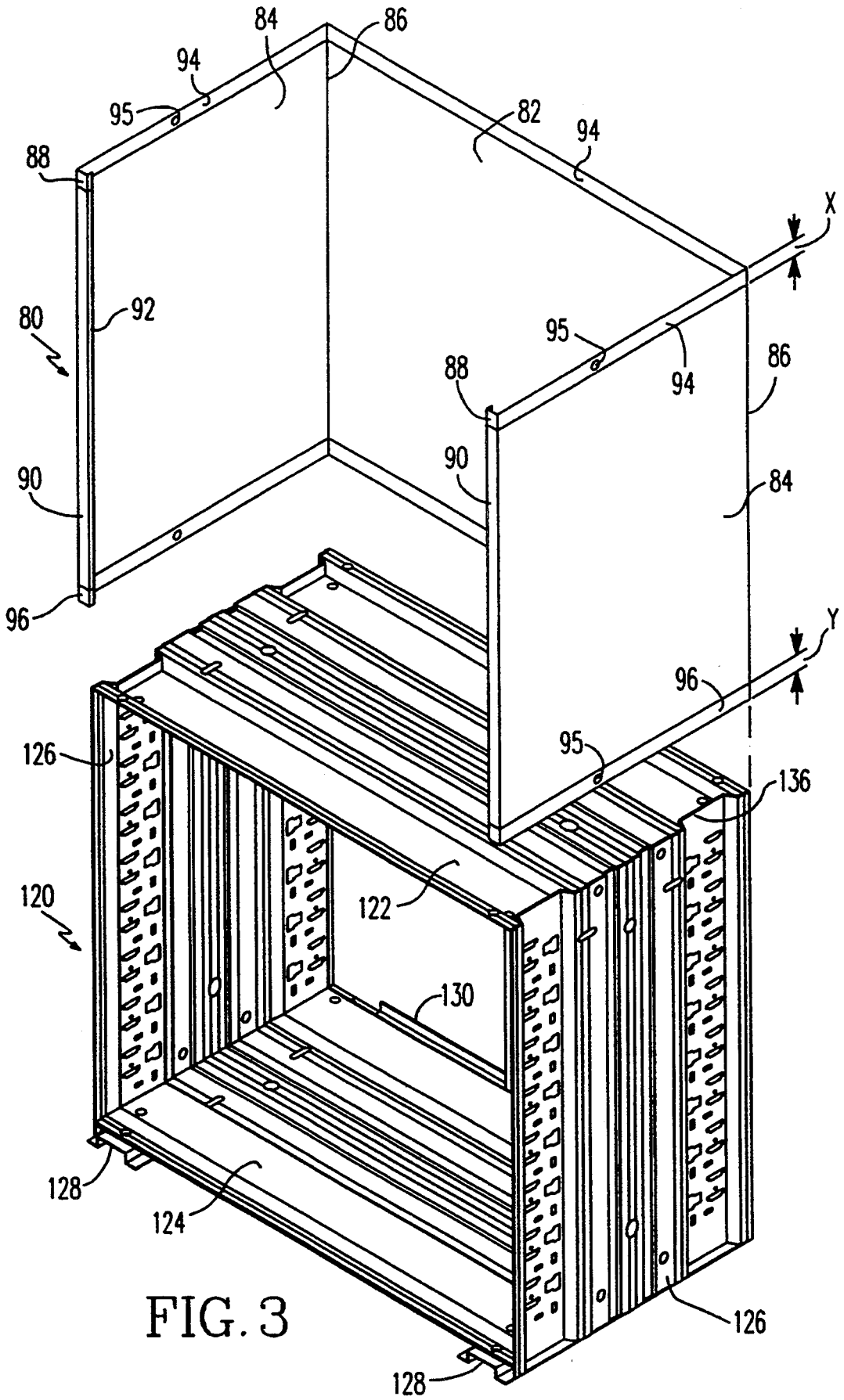
FIG. 3 is a partially exploded perspective view of the case illustrating the outer wrapper exploded away from the inner framework.
Figure 4:
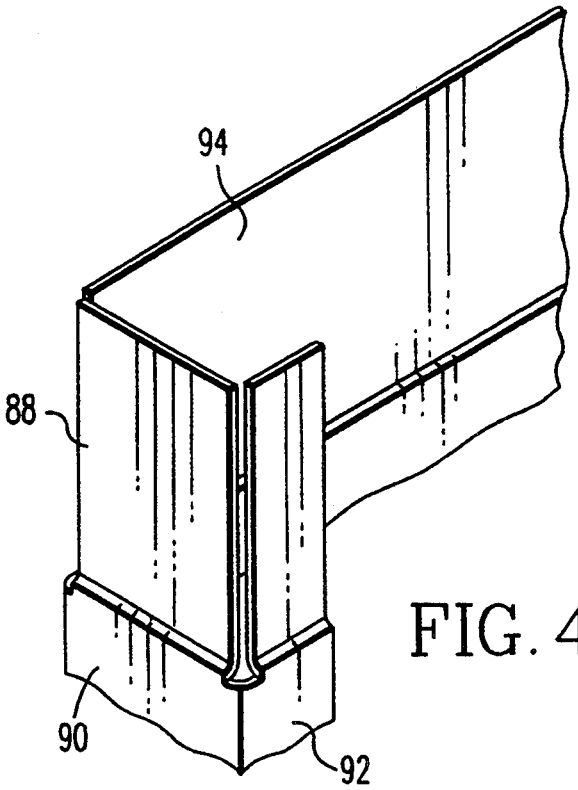
FIG. 4 is a perspective view of a corner of the upper ledge of the outer wrapper.
Figure 6:
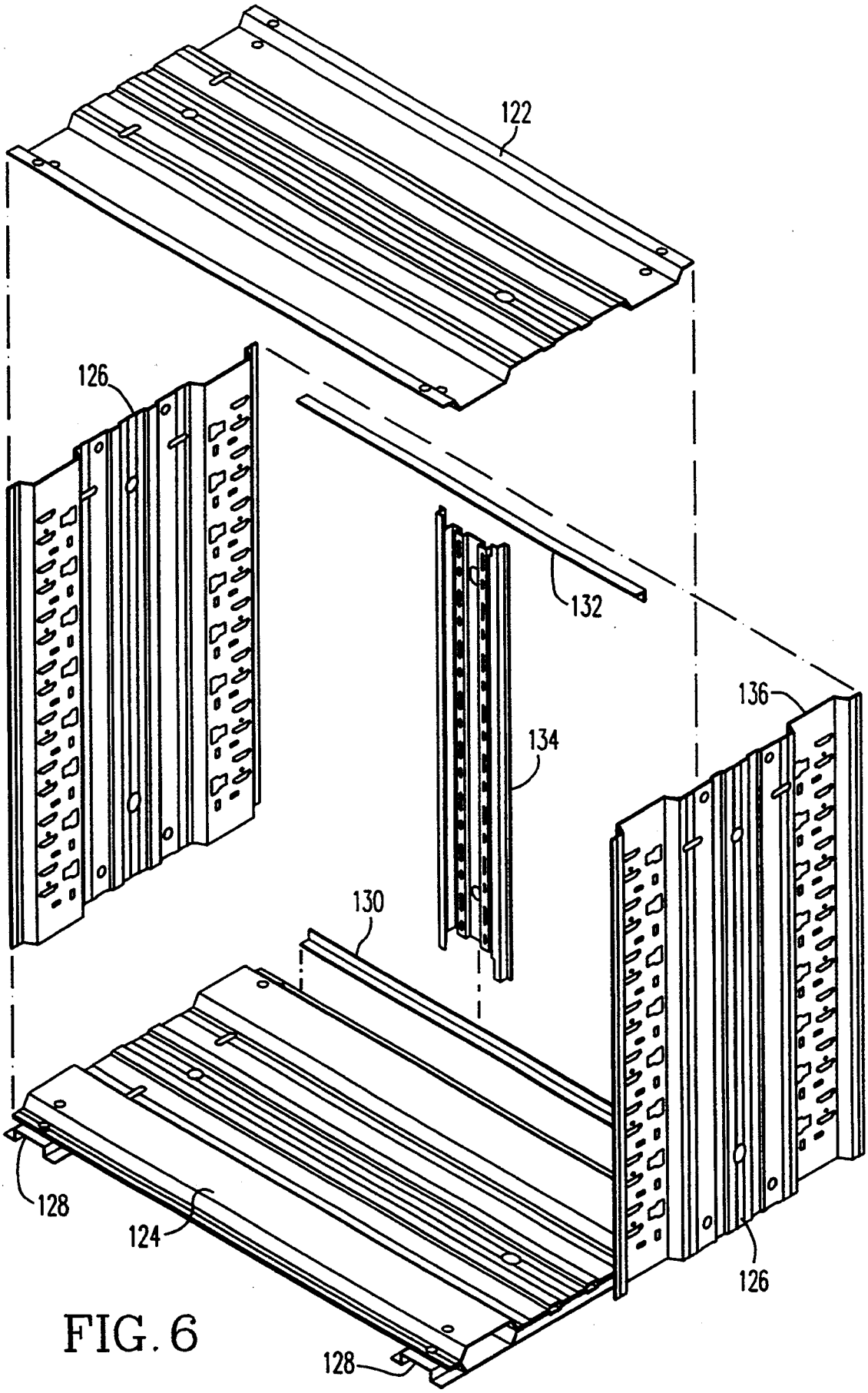
FIG. 6 is an exploded perspective view of the inner framework of the case.

Referring now in detail to the drawings wherein like reference characters represent like parts throughout the several views, there is illustrated in FIG. 1 a lateral filing cabinet which is one embodiment of the metal case referred to in this specification. The metal case 20 includes a top pan 40, a base pan 60, an outer wrapper 80, and in this instance, drawers 100. FIGS. 2, 3 and 6 illustrate various exploded views of the metal case 20 in order to clearly demonstrate the major components and construction of the case.

FIG. 2 illustrates the metal case 20 with top pan 40, base pan 60, and one of the drawers 100 exploded in order to show a portion of the inner framework 120. Further illustrated in FIG. 2 is a drawer glide 200 which is easily snapped into the inner framework 120 in order to accommodate drawers 100. The drawer glide 200 will be discussed more completely after all of the major components of the case 20 have been fully described.

The top pan 40 is formed from a single sheet of metal which may be 22 gauge steel and includes a top 42 and four shallow sides 44, each of which are substantially perpendicular to the adjacent sides and to top 42, thereby resembling the lid of a box. The front side edge 46 of top pan 40 includes an inner lip or reveal (not shown), which is bent inwardly perpendicular to front side edge 46 and parallel to top 42.

Base pan 60 is also formed from a single sheet of 22 gauge sheet metal and may be similar in appearance to top pan 40. Base pan 60 may vary in height to accommodate the customer's needs. Base pan 60 includes a bottom 62 and four sides 64, each of which are substantially perpendicular to the adjacent sides and to bottom 62. Front side edge 66 of base pan 60 further includes an inner lip or reveal 68, which is bent inwardly perpendicular to front side edge 66 and parallel to bottom 62. Inner lip 68 may not extend the entire length of front side edge 66, thereby defining spaces 70 on either end of lip 68. Base pail 60 further includes four apertures 72 which may be located in the four outer corners of bottom 62 of base pan 60.

The seamless outer wrapper 80, more fully illustrated in FIGS. 2, 3, 4 and 5 comprises a single sheet of metal such as 22 gauge steel and formed to define a three-sided, generally C-shaped surface, including a back wall 82 and two side walls 84. Side walls 84 extend substantially perpendicularly from either end 86 of back wall 82 and terminate in U-shaped bends 88. Each U-shaped bend 88 is defined by a bend 90 perpendicular to side wall 84 and an inward bend 92 parallel to side wall 84. Outer wrapper 80 further includes an upper ledge 94 and a lower ledge 96. Upper ledge 94 and lower ledge 96 are roll formed in the sheet metal comprising outer wrapper 80 as an upper and lower indentation which may extend substantially the entire perimeter of the outer wrapper 80. Upper ledge 94 and lower ledge 96 include openings 95 which aid in alignment of the outer wrapper 80 when being assembled to the case 20. Upper ledge 94 measures approximately one inch as indicated by the line x, which corresponds to the length of the sides 42 of top pan 40. Likewise, lower ledge 96 measures approximately one inch as indicated by the line y, which corresponds to the length of the sides 64 of base pan 60. The measurement of lower ledge 96 may vary depending on the height of the base pan 60 requested by consumers. Therefore, when metal case 20 is assembled, which will be described in greater detail later in the specification, top pan 40, which is placed over the top of the case, fits snugly over upper ledge 94 and base pan 60, which covers the bottom of the case, fits snugly over the lower ledge 96.

Still referring to FIG. 3 and in addition to FIG. 6, the inner framework 120 which resembles a box is comprised of a top panel 122, a bottom panel 124, which is actually two top panels 122 placed back-to-back and welded together, and two side panels 126. Each panel may have substantially the same configuration, thereby providing for ease of production and assembly. Furthermore, the similar configuration is readily adaptable to mass production. The dimensions of each panel correspond to the dimensions of the case, for example, top panel 122 may extend substantially the entire length and depth of the top of metal case 20, side panels 126 may extend substantially the entire depth and height of metal case 20 and so on thereby creating a "box within a box." Therefore, the inner framework provides a stronger frame which does not rely on the outer housing for the structural integrity of the metal case.

Top panel 122, each portion of bottom panel 124 and side panels 126 may be roll formed 20 gauge steel. As can be seen from the drawings these panels may have substantially the same thickness and cross-section so that they may be produced from the same stock. The panels nay be joined to the adjacent panel by welding at various points along their adjoining edges.

Referring to FIG. 6, a rail 128 may be attached by welding to each end of the bottom of bottom panel 124 thereby providing a base or feet to metal case 20. A first attachment strip 130 may be welded to the back portion of bottom panel 124 and a second attachment strip 132 may be welded to the back portion of top panel 122. A corrugated metal retention channel 134 may be welded near its bottom end to first attachment strip 130 and welded near its upper end to second attachment strip 132. Channel 134 provides structural rigidity to the back of metal case 20 and provides a means to attach a locking mechanism (not shown) to metal case 20. The locking mechanism which may be chosen from those well known in the art such as one manufactured by Engineered Security Products Corporation of Leominster, Mass., may be provided to lock drawers 100 in the closed position and prevent tipping of the case.

Figure 7:
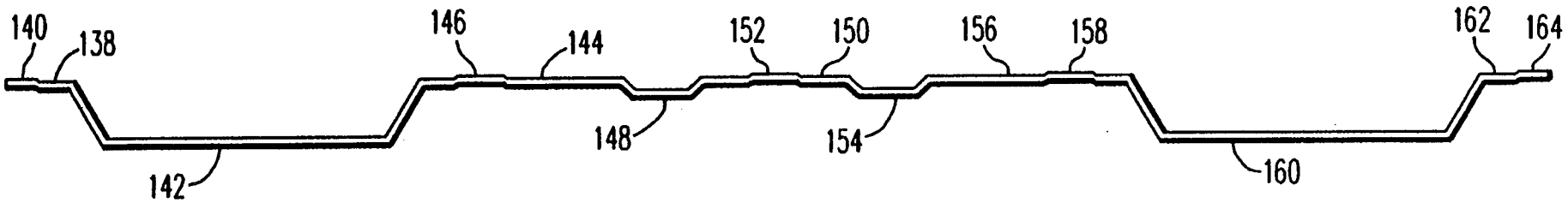
FIG. 7 is a top plan view of one of the side panels of the inner framework.
Figure 8:
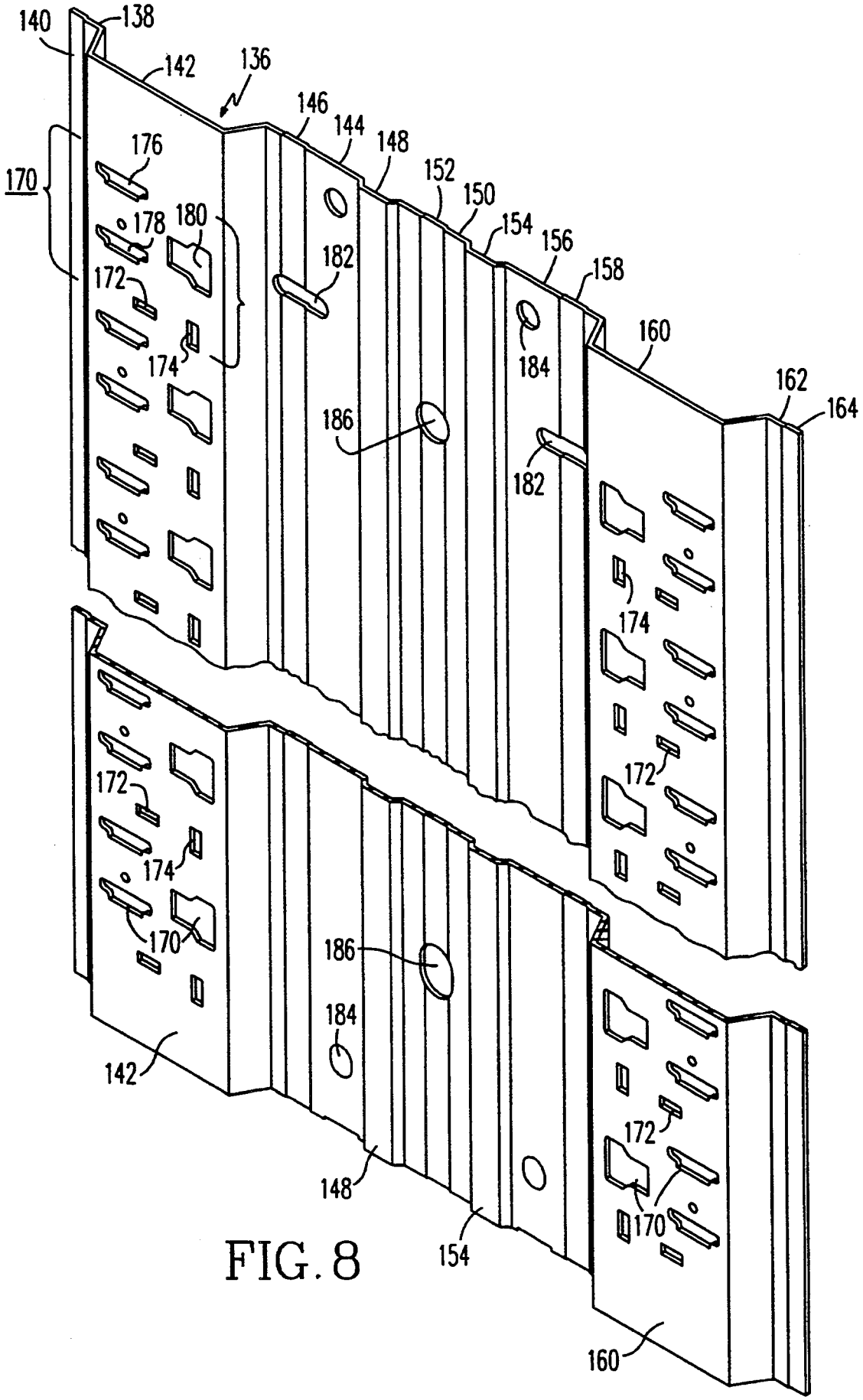
FIG. 8 is a perspective view of one of the side panels of the inner framework.

Referring now to FIGS. 6, 7 and 8 a typical edge 136 of a panel such as side panel 126 illustrates the general cross-sectional configuration of top panel 122, side panels 126 and each portion of bottom panel 124 which configuration extends substantially the entire length of the panel. The cross-section of a panel such as side panel 126 defines a first ridge 138 having a first land 140, an adjacent first trough 142, adjacent second ridge 144 having a second land 146, adjacent second trough 148, adjacent third ridge 150 with third land 152, adjacent third trough 154, adjacent fourth ridge 156 with fourth land 158, adjacent fourth trough 160 and adjacent fifth ridge 162 with fifth land 164. Lands 140, 146, 152, 158 and 164 may have a height of approximately 0.030 inches, troughs 142 and 160 may have a height of approximately 0.65 inches, and troughs 148 and 154 may have a height of approximately 0.14 inches. The combination of troughs and ridges provides structural rigidity to metal case 20 while allowing for the use of thinner less expensive metal members. Lands 140, 146, 152, 158 and 164 on side panels 126 provide metal to metal surface contact with wrapper 80. An adhesive such as a heat curable epoxy 954 available from Essex Specialty Products may be applied to ridges 138, 144, 150, 156 and 162. The adhesive tends to fill the space created between the ridges and the outer wrapper, while allowing substantial metal to metal contact between the lands and the outer wrapper. This adhesive provides a means to attach wrapper 80 to side panels 126 and enhances the sound deadening qualities of metal case 20. Ridges 138, 144, 150, 156, and 162 of top panel 122 also provide surface areas to which an adhesive such as a two part room temperature curable polyurethane adhesive 73010-A and 73010-B available from Essex Specialty Products may be applied. This adhesive provides a means to attach top pan 40 to top panel 122, to attach base pan 60 to bottom panel 124 and to secure the back expanse of wrapper 80 to the rear of channel 134 while enhancing sound deadening qualities. The use of adhesive in this manner greatly reduces the surface area affected by metal to metal rubbing and increases acoustical insulation.

As an alternative, lands 140, 146, 152, 158 and 160 may be replaced by dimples, which would not extend substantially the entire length of the panel.

Figure 9:
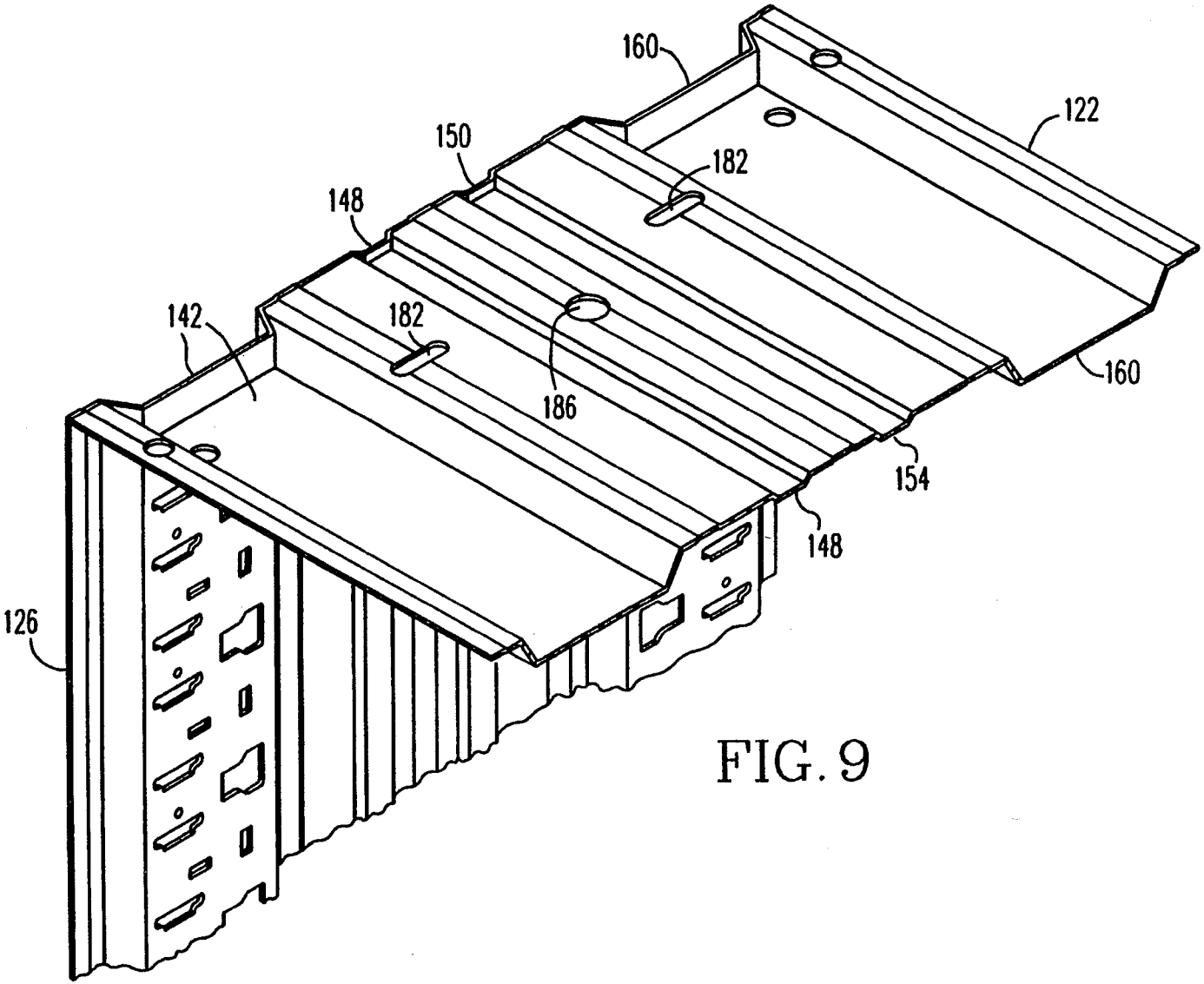
FIG. 9 is a perspective view of the upper left-hand corner of the inner framework illustrating the way in which the top panel and the left side panel are arranged and secured.

As can be seen in FIGS. 3 and 9 top panel 122 has substantially the same cross-sectional configuration as side panels 126 except that troughs 142, 148, 154 and 160 of top panel 122 do not extend quite the length of top panel 122 so that the corresponding troughs of side panels 126 meet in a complimentary fashion. Likewise, ridges and lands of top panel 122 interconnect with the corresponding portion of side panels 126 to form a tight matching fit along adjoining edges where the panels may be welded together.

Again referring to FIG. 8, first trough 142 and fourth trough 160 have first openings 170 formed therein for attachment of drawer glides and door hinges, and second openings 172 and third openings 174 formed therein for accommodating receding door locking clips (not shown). The case may include a receding door alternative embodiment not disclosed herein. First openings 170, second openings 172 and third openings 174 thereby comprise a set which may be arranged in an orderly repeating fashion along first trough 142 and fourth trough 160. Each repeating set of openings may be formed in a simultaneous stamping to minimize-tolerance stack-up. In addition, these openings are positioned in first trough 142 and fourth trough 160 in a generally symmetrical manner about the longitudinal center line of side panels 126. Because of this configuration, side panels 126 are interchangeable. That is, any side panel 126 may be used as a side panel on either side of metal case 20.

First openings 170, which interchangeably accommodate drawer glides or door hinges, both of which will be discussed presently in this application, are comprised of a set of three slots which are equidistantly spaced from each other and the other repeating sets of first openings 170 along first trough 142 and fourth trough 160. Brackets surrounding one set of the three slots which comprise first openings 170 is provided in FIG. 8 for clarity. The set of three slots comprising first openings 170 include an upper elongated slot 176, a lower elongated slot 178 and an intermediate wide slot 180. Upper elongated slot 176 and lower elongated slot 178 may be spaced one above the other and may be of the same configuration resembling squatty "T" shapes. Intermediate wide slot 180 may be located intermediate and offset laterally and inwardly from upper and lower elongated slots, 176 and 178, respectively. Intermediate wide slot 180 may resemble a "T" shape which has been rotated on its side. Note that upper elongated slots 176, lower elongated slots 178 and intermediate wide slots 180 located on first trough 142 are mirror images of upper elongated slots 176, lower elongated slots 178 and intermediate wide slots 180 located on fourth trough 160.

Top panel 122, bottom panel 124 and side panels 126 may also have fourth openings 182 therein for fabrication purposes during the roll forming process which trigger the simultaneous stamping of openings 170, 172 and 174. Additionally, top panel 122, bottom panel 124, and side panels 126 may include fifth openings 184 and sixth openings 186 for alignment and assembly purposes, so that the case may be properly-constructed during mass production. It may be noted that top panel.122, the portions of bottom panel 124 and side panels 126 are basically of the same configuration and may be manufactured from the same material and process but with side panels 126 having additional openings.

Figure 10:
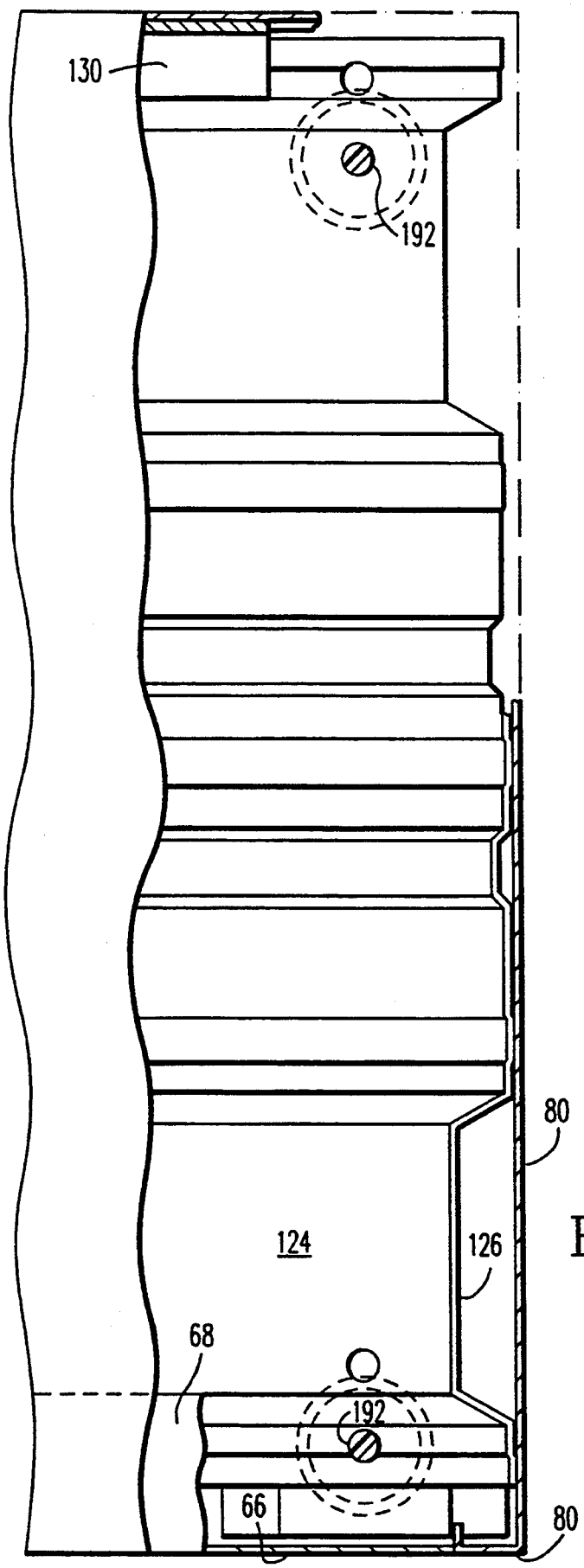
FIG. 10 is a partial top plan view, partly in section, of the case.
Figure 11:
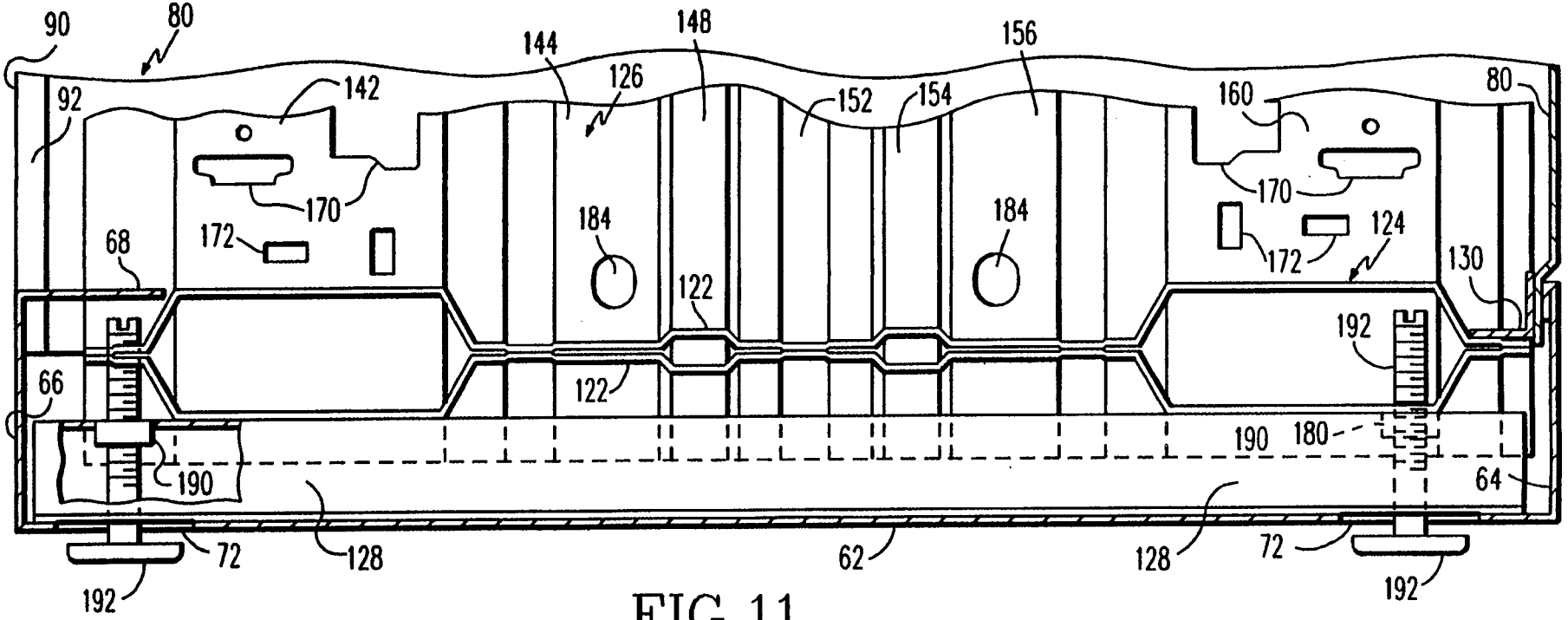
FIG. 11 is a cross-sectional view in elevation of the side of the bottom portion of the case.

Referring to FIGS. 10 and 11, bottom panel 124 may comprise two panels such as top panel 122 inverted and welded together as shown in cross-section in FIG. 11. In this manner, bottom panel 124 provides additional strength and height while utilizing panels having substantially the same cross-sectional configuration as side panels 126 and top panel 122.

Bottom panel 124 may be attached on its underside to rails 128 as shown in FIGS. 3, 10 and 11. Rails 128 function as feet for metal case 20 while supporting metal case 20 through bottom panel 124.

As may be seen in FIG. 10, bottom panel 124 is configured near each end similar to top panel 122 so that side panels 126 mate with bottom panel 124 and may be welded together at that intersection. This mating configuration may also be seen in FIG. 3.

Again referring to FIGS. 10 and 11, nuts 190 may be attached to rail 128 near each end so that threaded levelers 192 may be threadedly engaged therethrough. Levelers 192 are disposed within the channel of rail 328 and extend through apertures 72 of bottom 62 of base pan 60. Levelers 192 may be accessed and adjusted through the interior of metal case 20 so that metal case 20 may be leveled on its supporting surface such as a floor.

Now referring to FIG. 12 and accompanying FIGS. 13–21, the drawer glides of this application will be discussed. The drawer glides have several attributes, including a snap-in capability and a load bearing capability. The drawer glides easily snap into the openings provided in the side panels of the case and also snap into the drawers, thereby eliminating the need for excess parts and hardware. The drawer glides are also unhanded, meaning only one glide is necessary for attachment to both side panels of the case and both sides of a drawer. No right hand or left hand parts are required.

Figure 12:
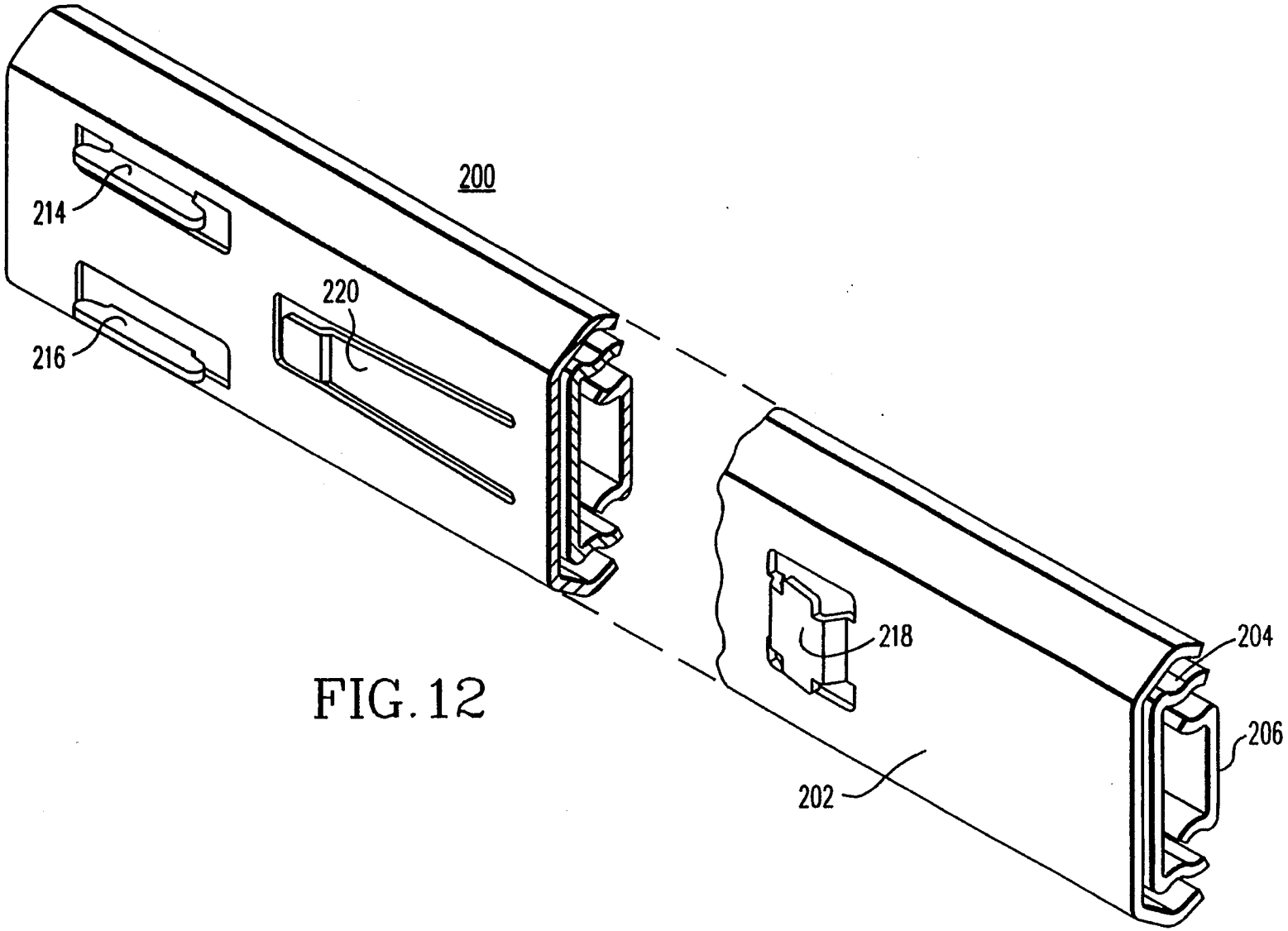
FIG. 12 is a perspective view of the snap-in drawer glide attachment.
Figure 13:
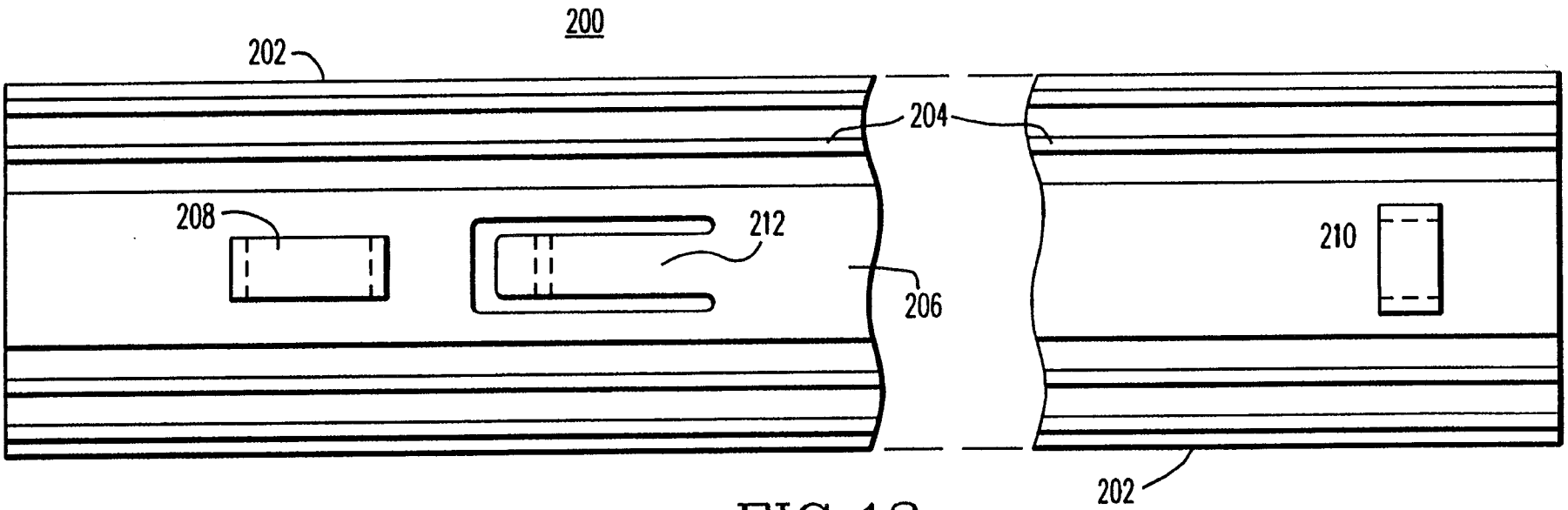
FIG. 13 is an elevational view of the inner rail of the snap-in drawer glide attachment.
Figure 14:
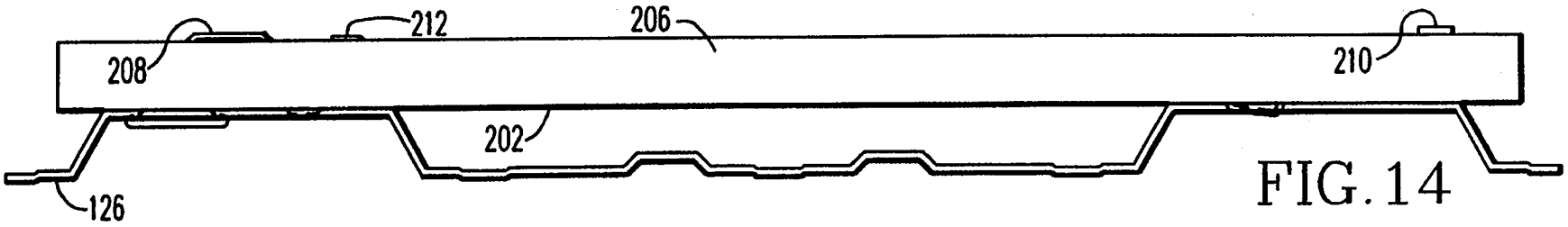
FIG. 14 is a top plan view of the snap-in drawer glide attachment disposed on one of the side panels of the inner framework, in this instance the left side panel.
Figure 15:
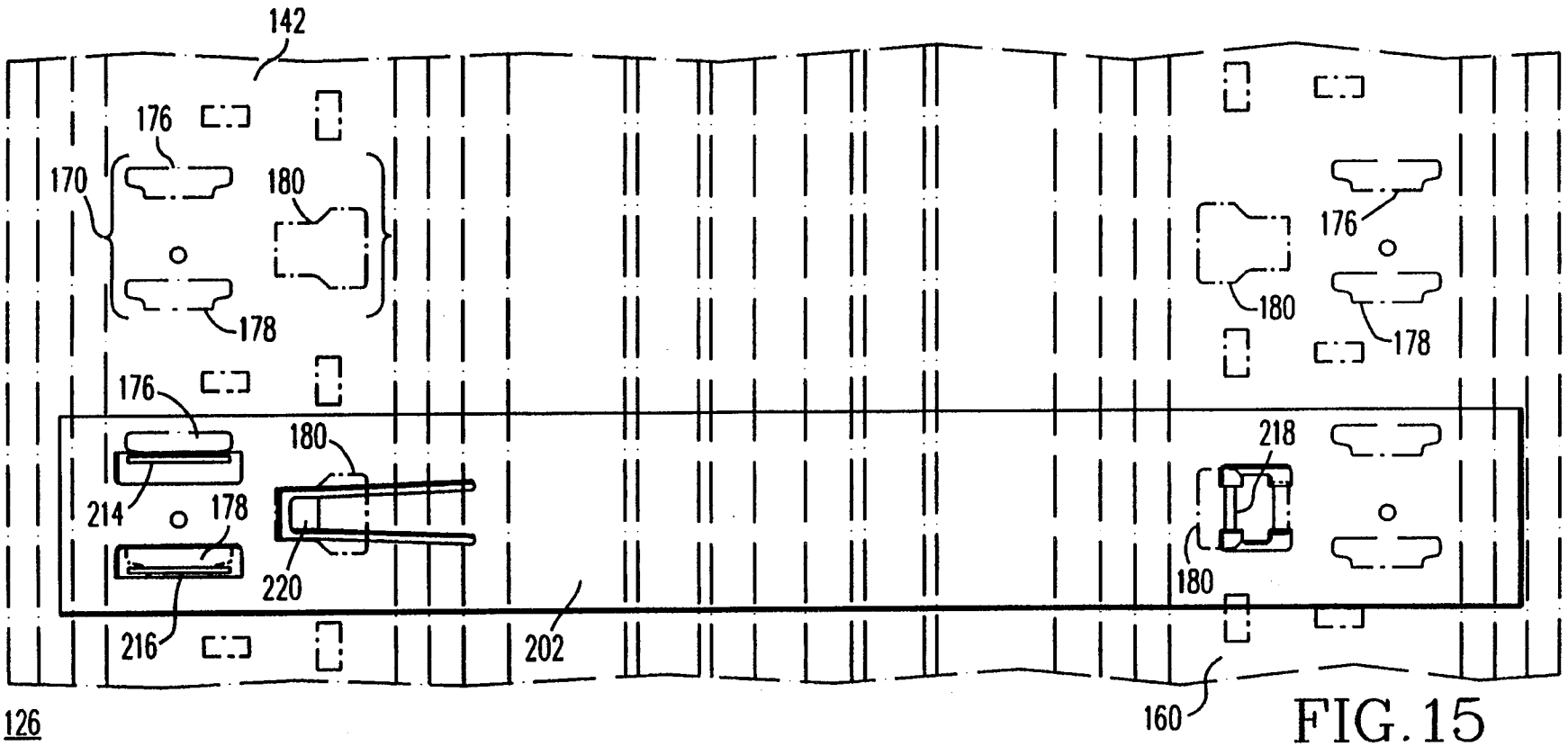
FIG. 15 is an elevational view of the snap-in drawer glide attachment disposed on the side panel of the inner framework, the side panel shown in phantom.
Figure 16:
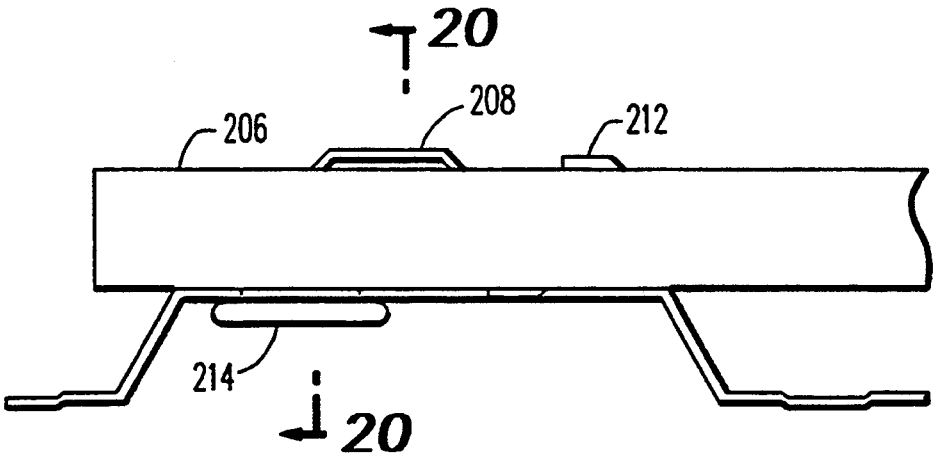
FIG. 16 is a top plan view of the first end of the snap-in drawer glide attachment disposed on the left side panel.
Figure 17:
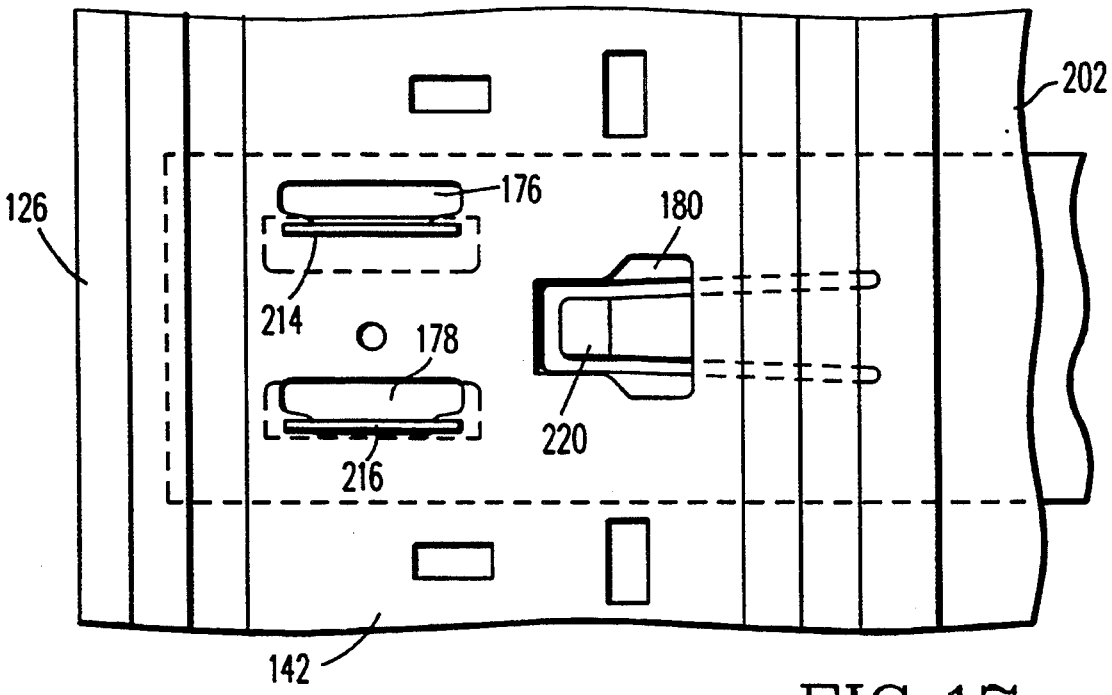
FIG. 17 is an elevational view of the first end of the snap-in drawer glide attachment, shown in phantom, disposed on the side panel.
Figure 18:
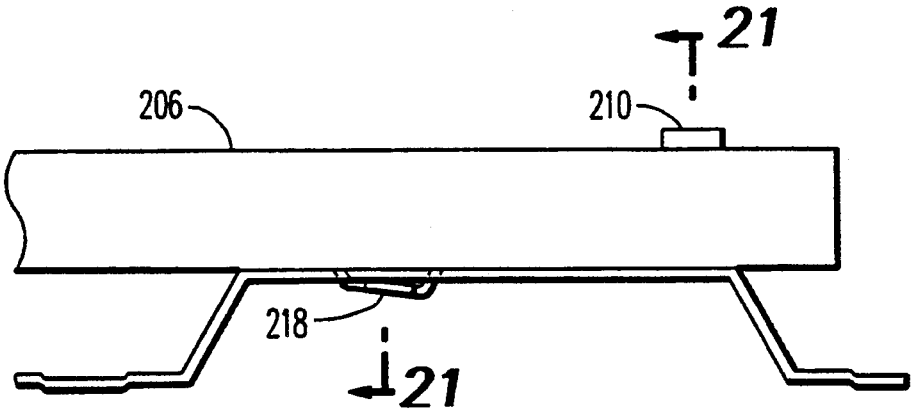
FIG. 18 is top plan view of the second end of the snap-in drawer glide attachment disposed on the left side panel.
Figure 19:
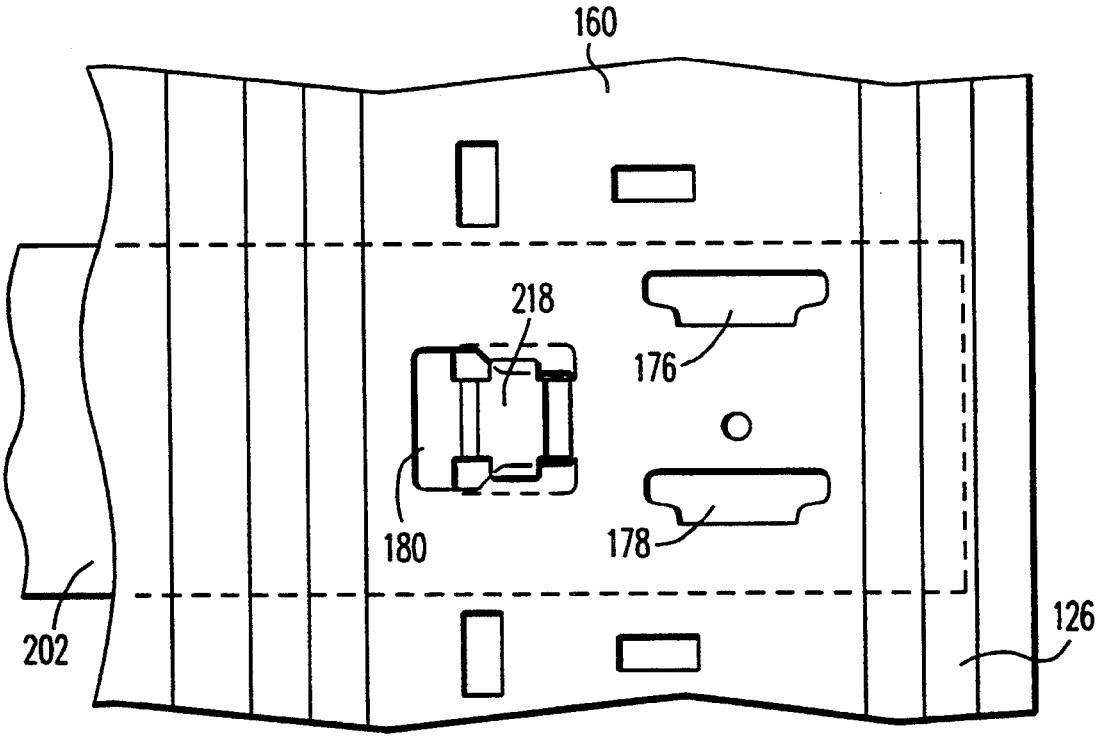
FIG. 19 is an elevational view of the second end of the snap-in drawer glide attachment, shown in phantom, disposed on;he side panel.
Figure 20:
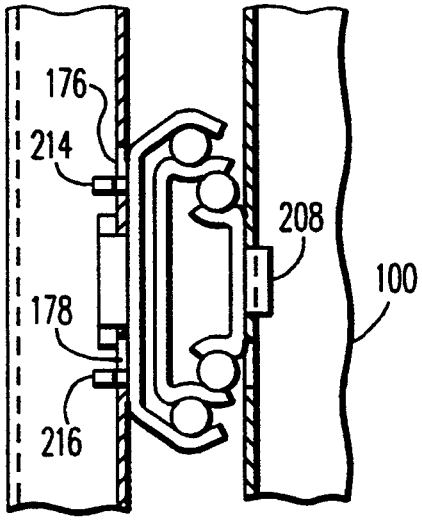
FIG. 20 is a cross-sectional view of FIG. 16 taken along line 20—20.
Figure 21:
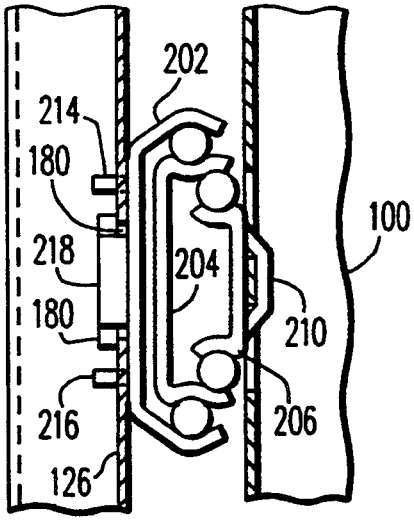
FIG. 21 is a cross-sectional view of FIG. 18 taken along line 21—21.

FIG. 12 illustrates the drawer glide 200, such as one manufactured by Accuride, a drawer glide including progressive telescoping suspensions and constructed of roll-formed steel and fitted with ball bearings and retainers so as to minimize drawer noise and racking and reduce suspension wear. Drawer glide 200 includes three telescoping rails, an outer rail 202, an intermediate rail 204, and an inner rail 206. Inner rail 206 is more clearly illustrated in FIGS. 13, 14, 16, and 18 and includes a horizontal emboss 208, a vertical emboss 210 and an intermediately placed locking clip 212 which are formed in the metal of the glide 200 for snapping onto bayonet extensions formed on the outer sides of the drawers as illustrated at 102 and 104 in FIG. 2. Locking clip 212 coacts with slot 106. These embosses and locking clips may be arranged in various manners to accommodate the drawers; however they must be arranged symmetrically about a horizontal centerline in order to accomplish the unhanded requirement so that only one drawer glide design is needed. Referring back to FIG. 12, the outer rail 202 of drawer glide 200 includes two "T" shaped tabs, upper "T" shaped tab 214 and lower "T" shaped tab 216 which are lanced out of the parent material of the outer rail of the glide and extend out perpendicularly and are positioned one above the other at one end of outer rail 202 and a cross-shaped tab 218 centrally positioned at the other end of outer rail 202. A centrally located locking clip 220 is positioned intermediate laterally and inwardly of the upper and lower "T" shaped tabs 214 and 216 and the cross-shaped tab 218. Upper tab 214 mates with upper elongated slot 176 of first trough 142, lower tab 216 mates with lower elongated slot 178 of first trough 142, cross-shaped tab 218 mates with intermediate wide slot 180 of fourth trough 160 and locking clip 220 coacts with intermediate wide slot 180 of first trough 142. See FIGS. 15, 17 and 19. Upper tab 214, lower tab 216, cross-shaped tab 218 and locking clip 220 are all positioned symmetrically about a horizontal centerline so that one glide 200 may be used on both sides of the case thereby eliminating the need for a right-handed glide and a left-handed glide. Therefore glide 200 may be used on the right side panel 126 and the same configured glide 200 may be used on the left side panel 126 by simply inverting and flipping the glide 200 and attaching it to the left side panel 126 as described above.

Figure 22:
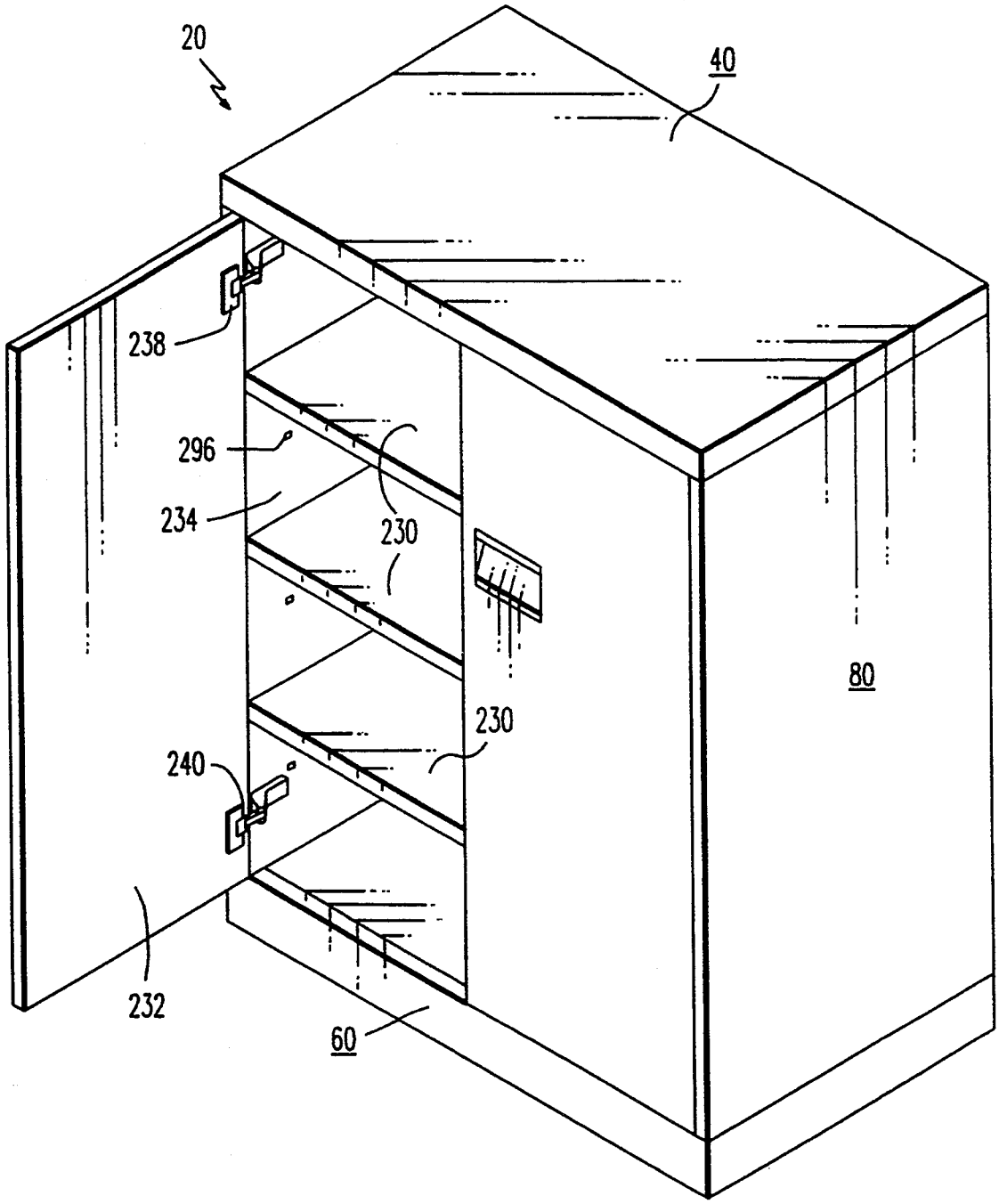
FIG. 22 is perspective view of a cabinet embodiment with shelves, doors and one of the trim panels for concealing the openings in the side panels of the inner framework.
Figure 23:
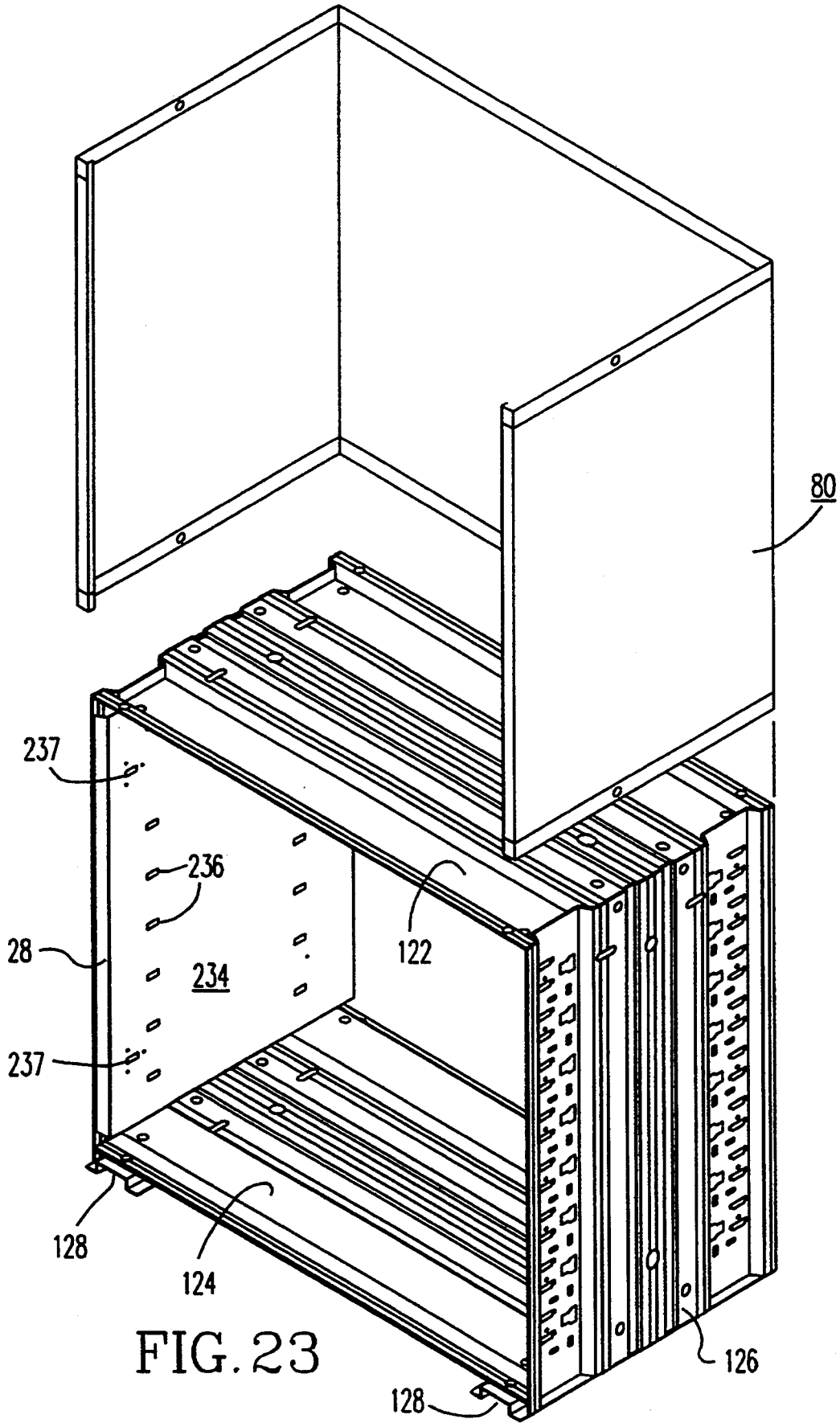
FIG. 23 is a partially exploded perspective view of the cabinet embodiment illustrating one of the trim panels with the outer wrapper exploded away from the inner framework.
Figure 24:
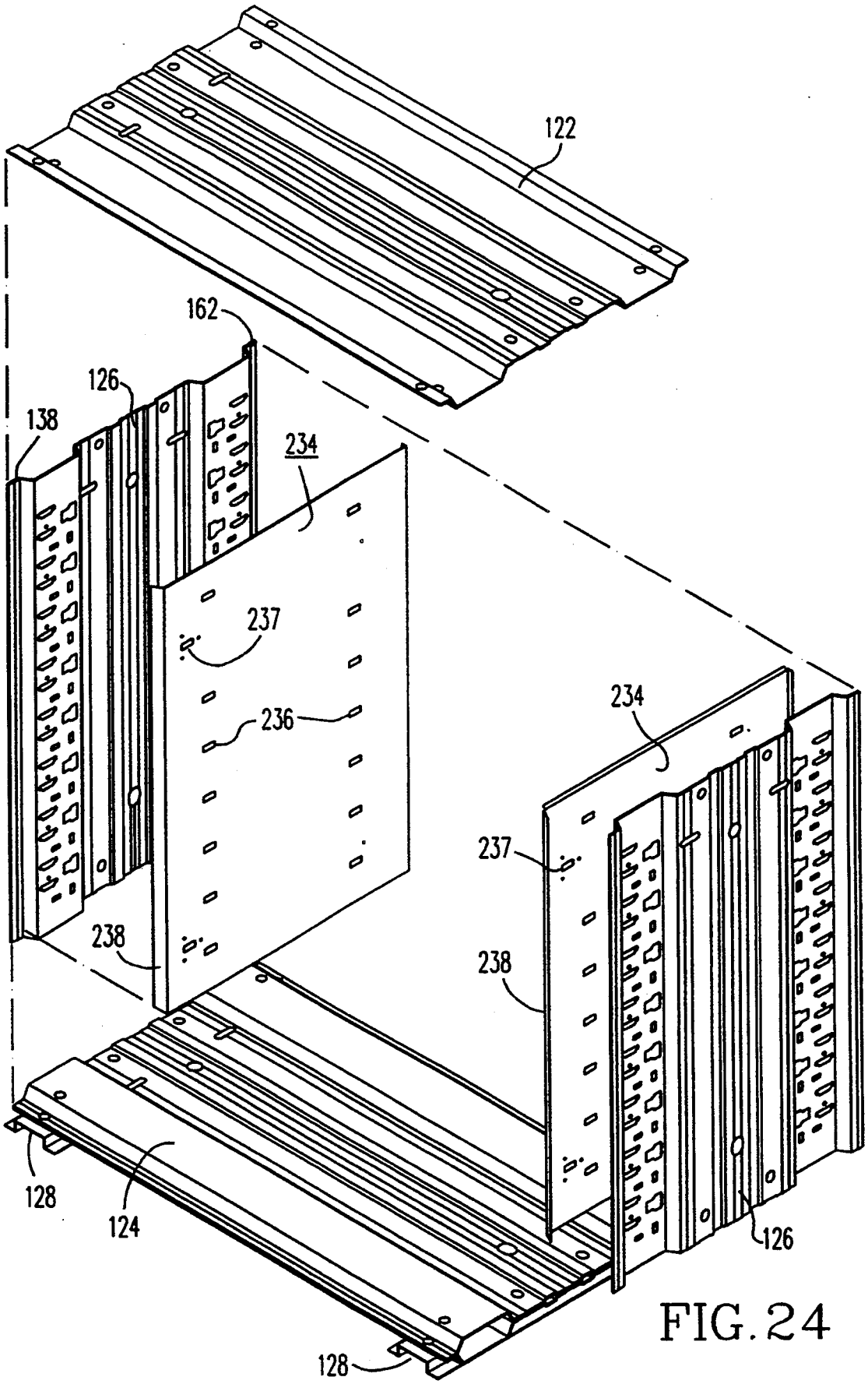
FIG. 24 is an exploded perspective view of the trim panels and the inner framework of the cabinet embodiment.

FIG. 22 illustrates another embodiment of the metal case 20 being a storage cabinet with shelves 230 and doors 232. In this embodiment trim panels 234 are attached to the interior of the inner framework 120 thereby finishing its interior. Trim panels 234 may have ports 236 therein for attachment of shelves and hinges.

FIGS. 23–29 illustrate the location and attachment of trim panels 234 and door hinge assemblies 240.

Trim panels 234 may be flat metal panels which extend substantially the entire depth and length of the interior of the case 20 in order to conceal the side panels 126 when a storage cabinet embodiment is desired. The side panels 126 with openings 170, 172, 174, 176, 178, 180, 182 and 184 therein may be considered unsightly when the cabinet door is opened. Trim panels 234 may be formed 20 gauge steel and may include first ports 236 which are stamped into the trim panels 234 in a symmetrical pattern so that a single trim panel configuration may be used to conceal both the left side panel and the right side panel. First ports 236 aid in shelf placement. Trim panel 234 may also include second ports 237 located at the upper and lower outer edges of the trim panel 234. Second ports 237 accommodate door hinge assemblies 240.

Trim panels 234 also include flanged side edges 238 which visually conceal first ridge 138 and fifth ridge 162 of side panel 126. Trim panel 234 may be further secured to side panel 126 by screws. See FIGS. 23–26.

Figure 25:
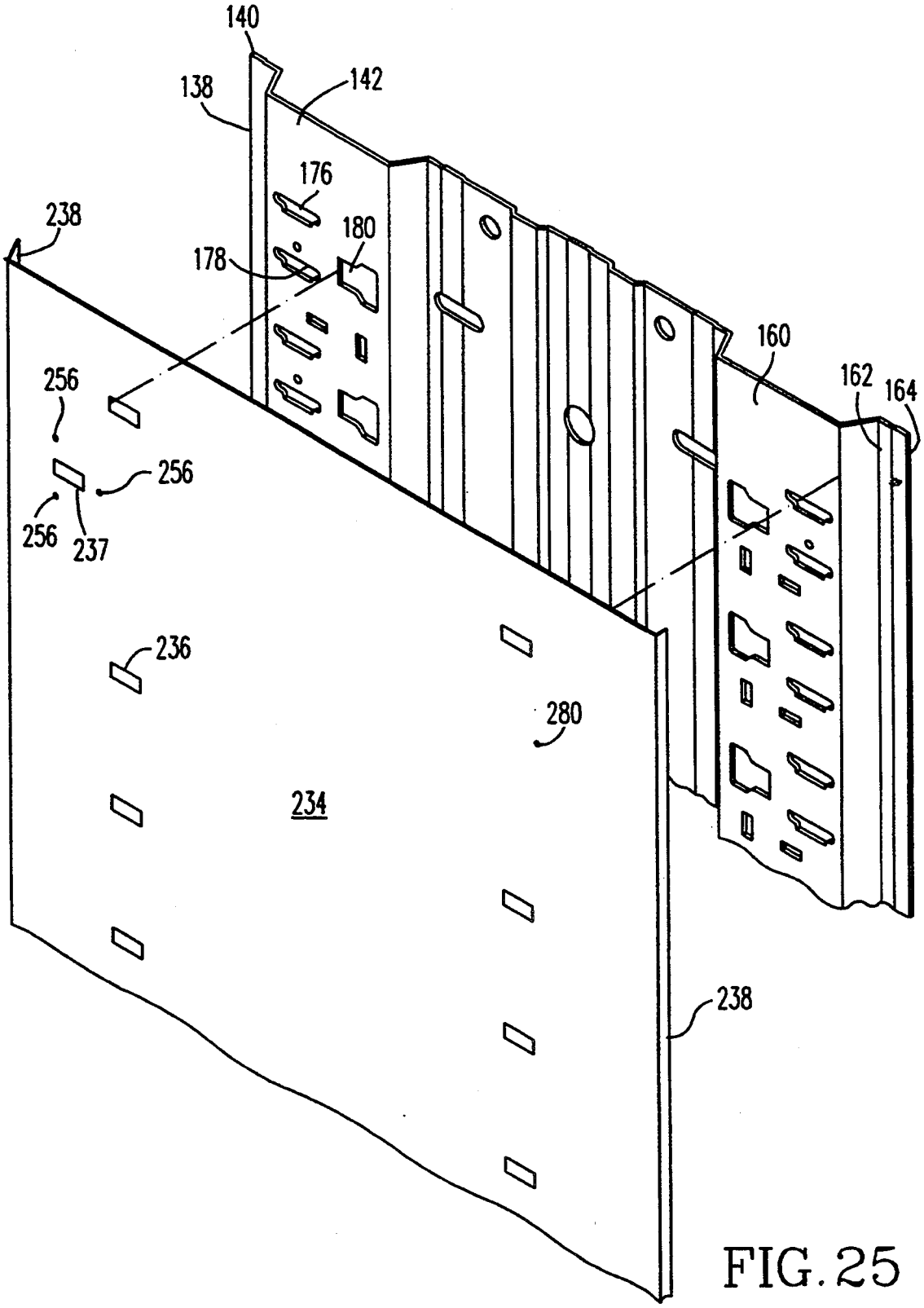
FIG. 25 is a partial perspective view illustrating the alignment of one of the trim panels with the right side panel.
Figure 26:
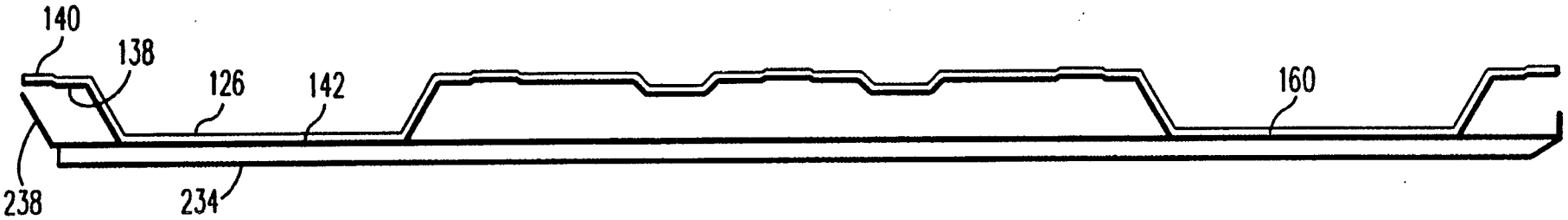
FIG. 26 is a top plan view illustrating one of the trim panels mounted to the right side panel.
Figure 27:
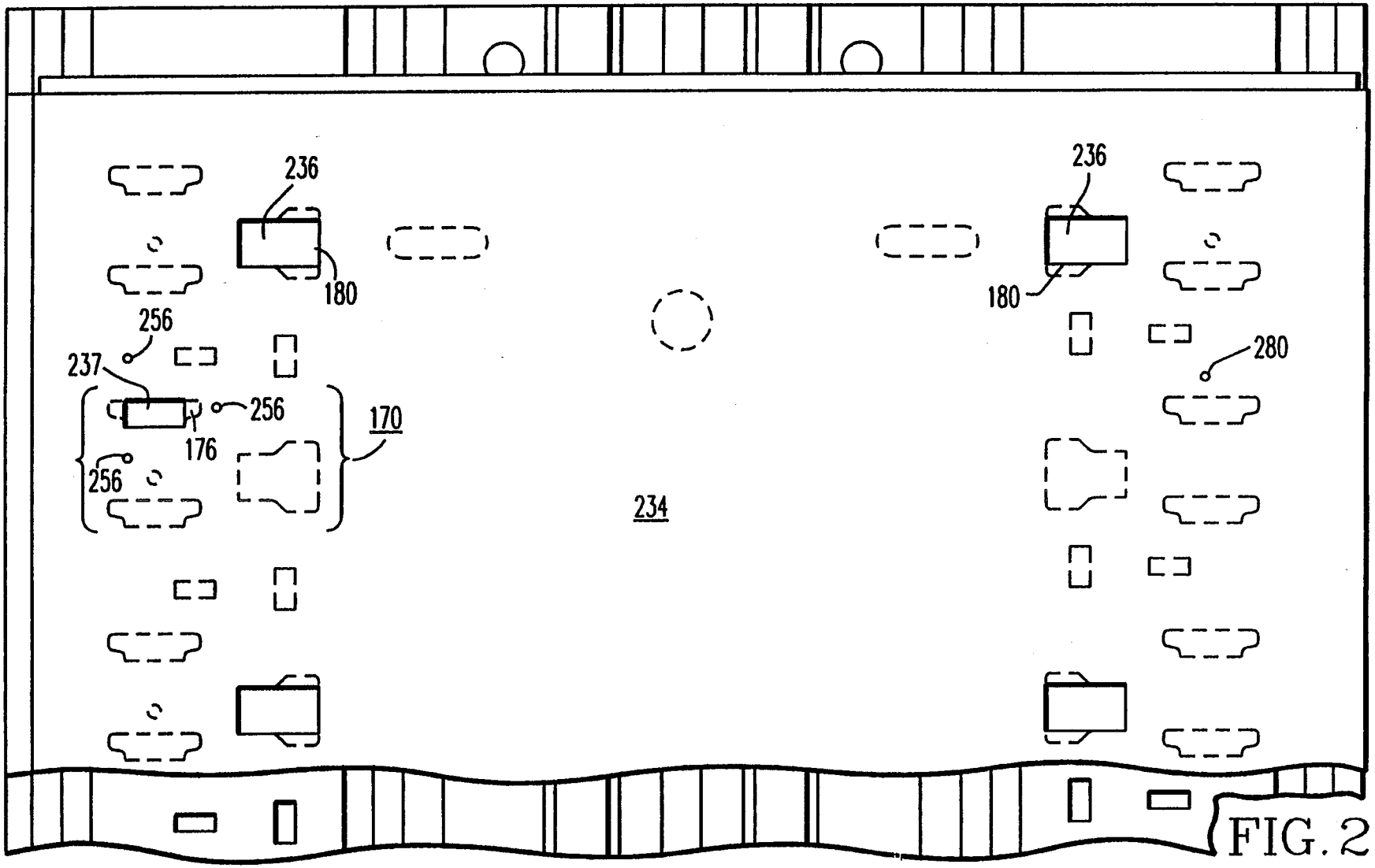
FIG. 27 is an elevational view of one of the trim panels disposed on the side panel with the openings of the side panel shown in phantom.

FIGS. 25 and 27 illustrate the way in which first ports 236 and second ports 237 of trim panels 234 may be aligned with first openings 170 of side panels 126. For example, the uppermost first ports 236 of trim panel 234 are aligned with the uppermost intermediate wide slots 180 of side panel 126 and so on continuing down the length of the panels. Second port 237 is offset on trim panel 234 laterally and outwardly from uppermost first port 236 and the next successive port 236. Second port 237 may be aligned with upper elongated slot 176 of the second set of first openings 170 of side panel 126, the second set of openings being indicated by brackets surrounding the openings in FIG. 27.

Figure 28:
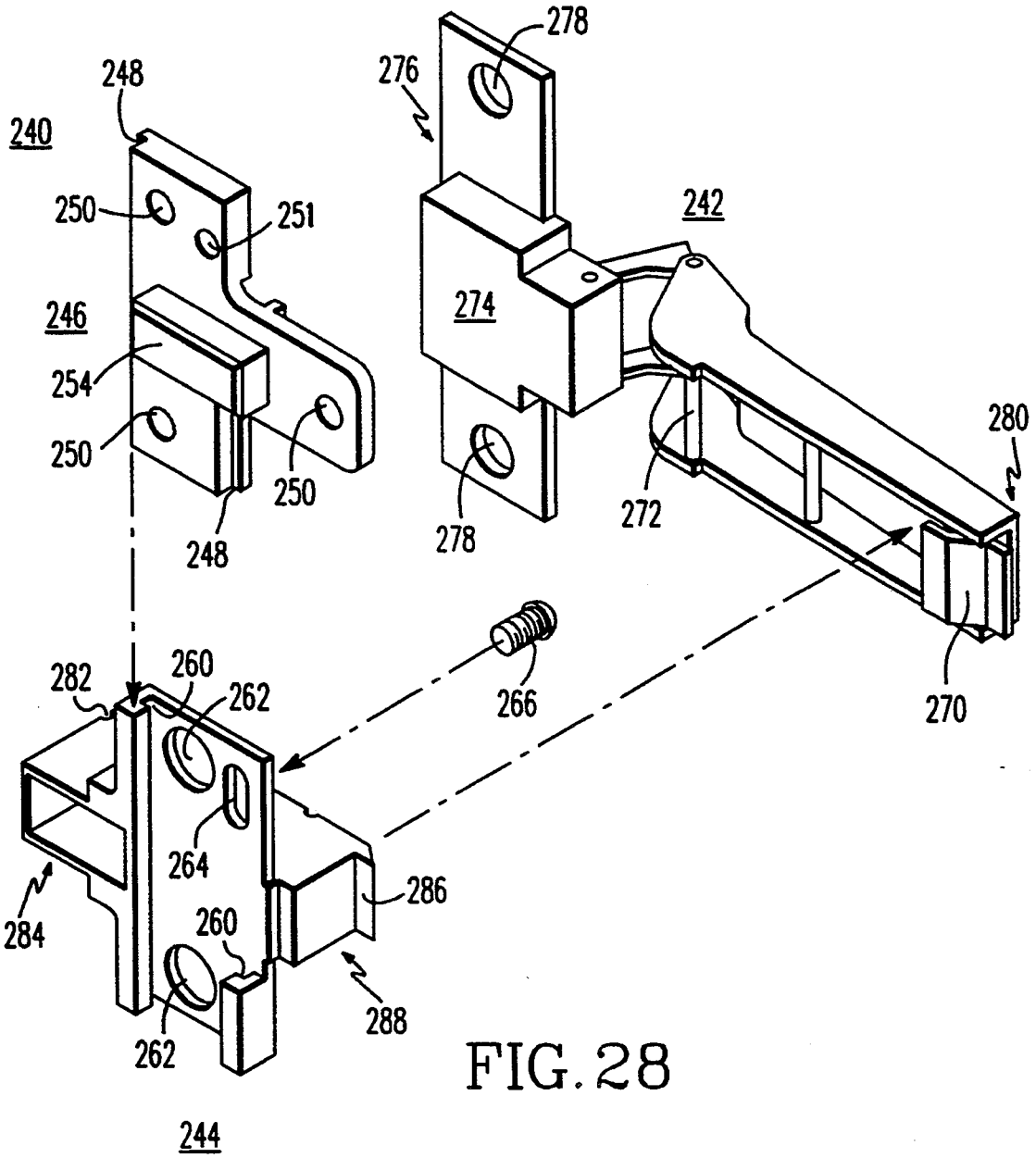
FIG. 28 is an exploded perspective view of the door hinge assembly attachment including the hinge, mounting base and hinge plate.
Figure 29:
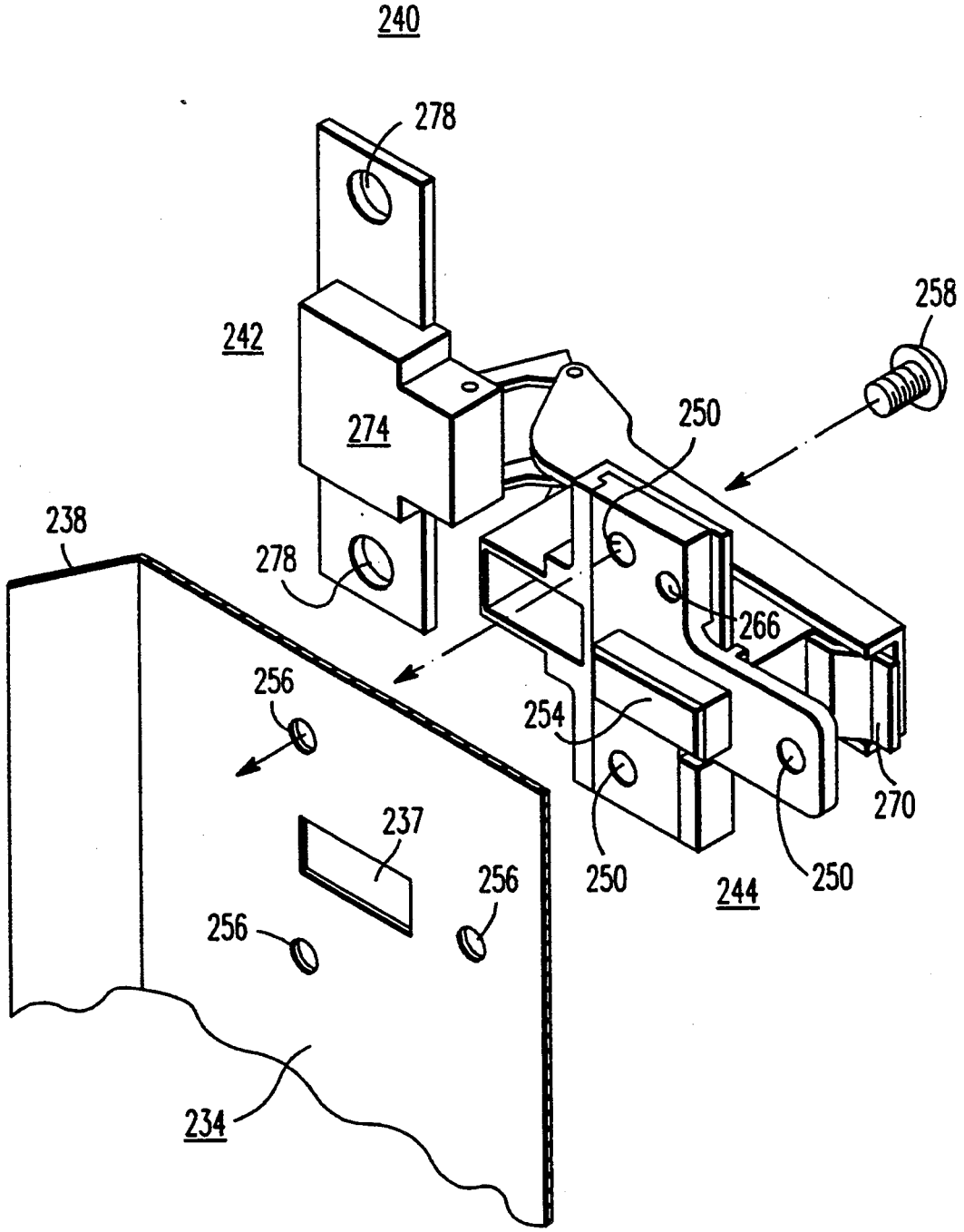
FIG. 29 is a perspective view of one of the door hinge assembly attachments illustrating the door hinge, mounting base and hinge plate interface with one of the trim panels.

Referring to FIGS. 28 and 29, the door hinge assembly 240 will now be discussed. The hinge assembly 240 which may be chosen from those well known in the art such as one manufactured by Blum Company includes a hinge 242, mounting base 244, and hinge plate 246. The hinge plate 246 is a "T" shaped metal plate including side flanges 248, openings 250 and 251, and a rectangular metal protrusion 254.

Rectangular protrusion 254 of hinge plate 246 interfaces with second opening 237 of trim panel 234 and upper elongated slot 176 of side panel 126 which is concealed by trim panel 234, and acts as a self-locator. This self-location causes the hinge plate 246 to be disposed on the trim panel 234 and the concealed side panel 126. Openings 250 of hinge plate 246 serve as drill hole locators, allowing drill holes 256 to be drilled into trim panel 234 and side panel 126, in order to secure with screws 258. No other drill fixture is needed. The coaction of rectangular metal protrusion 254 with second opening 237 in trim panel 234 and upper elongated slot 176 of side panel 126 acts as a self-location feature, while the close fit of metal protrusion 254 to second opening 237 and upper elongated slot 176 gives the entire hinge attachment added strength against possibility of door sag.

Mounting base 244 includes side ridges 260, openings 262 and a slot 264. Side ridges 260 of mounting base 244 slidably coact with side flanges 248 of hinge plate 246 and a screw 266 secures the mounting base 244 to hinge plate 246 through slot 264 and opening 251. Slot 264 is elongated in order to provide an adjustable capability when securing mounting base 244 to hinge plate 246.

Hinge 242 includes a spring loaded catch 270, a mounting pin 272 and a cupped mounting boss 274. Cupped mounting boss 274 is located on the first end 276 of hinge 242 and includes openings 278 through which screws are placed in order to attach first end 276 of hinge 242 to door 232. Hinge 242 also includes a second end 280 where spring loaded catch 270 is located. Further assembly of the hinged door requires engaging mounting pin 272 of hinge 242 to a groove 282 of mounting base 244 at it's first end 284, pivoting hinge 242 about pin 272 and engaging spring loaded catch 270 located at second end 280 of hinge 242 to a sloped metal protrusion 286 cast into mounting base 244 at its second end 288. Reversely, spring loaded catch 270 on hinge 242 is activated to remove the hinged door assembly from the cabinet.

Figure 5:
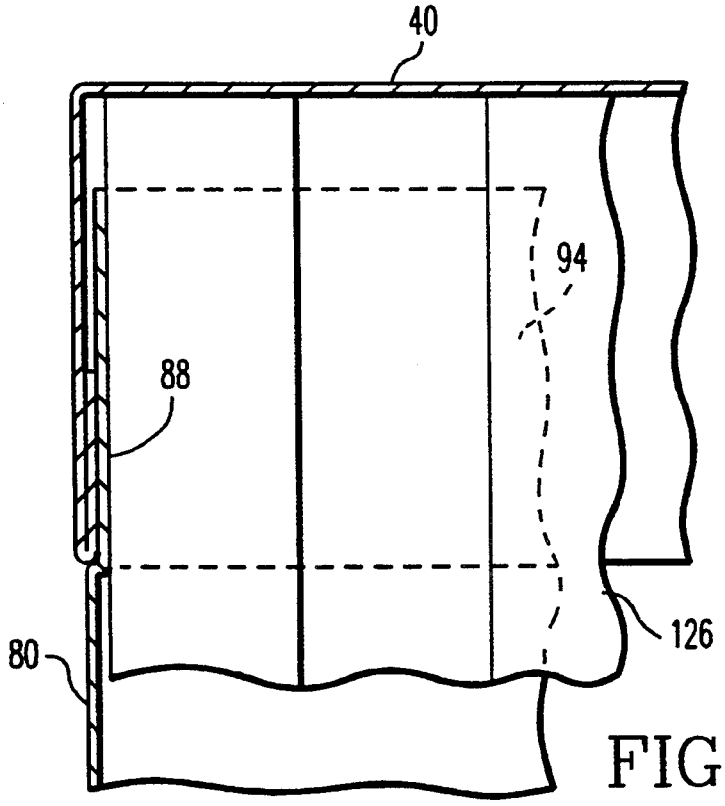
FIG. 5 is a cross-sectional view in elevation of a corner of the outer wrapper with the top pan attached.

In the assembly of metal case 20, top panel 122, bottom panel 124 and side panels 126 are welded together and rails 128 are attached to bottom panel 124 as shown in FIG. 3. Attachment strips 130 and 132 and channel 134 may also be welded in place. Channel 134 is not included if the storage cabinet embodiment is desired. Adhesive may then be applied to ridges 138, 144, 150, 156 and 162 of side panels 126. Then outer wrapper 80 may be carefully spread and disposed around inner framework 120 as depicted in FIGS. 2 and 3. Opening 95 may then be aligned with opening 184 of side panel 126 in order that the wrapper 80 may be properly aligned with the inner framework 120. When so arranged, outer wrapper 80 may be spot welded to inner framework 120 at points along upper ledge 94 and lower ledge 96. The assembly may then be heated to about 350° F. for approximately 20 minutes to cure the adhesive applied to side panels 126. Next, the air cured adhesive may be applied to ridges 138, 144, 150, 156 and 162 of top panel 122 and top pan 40 may then be placed on outer wrapper 80 as shown in FIGS. 1, 2 and 5. Of course, since top pan 40 has a lip or reveal, top pan 40 should be angled onto and over outer wrapper 80 and top panel 122. Similarly, the air cured adhesive may be applied to the bottom of the flanged ends of rails 128 and base pan 60 is then angled onto outer wrapper 80 and under bottom panel 124 and rails 128 so that inner lip or reveal 68 extends over bottom panel 124 as shown in FIG. 11. In this position, spaces 70 of bottom pan 60, which may also be located on the underside of top pan 40, may accommodate U-shaped bends 88 of wrapper 80. Before assembly, the outer corners of top pan 40 and base pan 60 may be plasma welded for greater strength and seamless design.

Once assembled as shown in FIG. 1 or FIG. 22, top pan 40 extends over upper ledge 94 and base pan 60 extends over lower ledge 96 thereby concealing the spot welds joining outer wrapper 80 to inner framework 120 thereby providing a double wall thickness of the entire top, sides and bottom of the case.

Drawers 100 or cabinet doors 232 may be added, depending on which embodiment of the metal case 20 is desired. If a lateral file is desired, drawer glides 200 are snapped into first openings 170 of side panels 126 at whatever height necessary depending on the number of drawers desired. Cross-shaped tab 218 is inserted into intermediate wide slot 180 of fourth trough 160 of side panel 126. Upper "T" shaped tabs 214 and 216 of outer rail 202 of drawer glide 200 are then inserted into upper elongated slots 176 and 178 of first trough 142 of side panel 126. "T" shaped tabs 214 and 216 are engaged into elongated slots 176 and 178 of panel 126 using a downward motion applied to the forward end of the drawer glide 200, at which time locking clip 220 coacts with intermediate slot 180 of first trough 142, thereby securing drawer glide 200 to side panel 126. The mating of upper tab 214 with upper elongated slot 176 results in primary securement; this securement is above the centerline of the glide thereby resulting in a load transfer of the glide to the side of the cabinet as the glide "hangs" from its attachment and "swings in" to rest against the cabinet side panel. The mating of lower tab 216 and lower elongated slot 178 results in secondary securement; lower elongated slot 178 may be used either as secondary attachment or merely as a clearance feature. This procedure is repeated for the other side panel on the opposite side of the case by using another drawer glide 200 by simply flipping and inserting glide 200 and inserting as previously described. Inner rails 206 of drawer glides 200 are then extended outwardly so that drawers 100 may be attached by mating bayonet extensions formed on the outer sides of the drawers to embosses 208 and 210 of inner rail 206 of glide 200.

If a storage cabinet embodiment is desired, trim panels 234 are placed over side panels 126 so that flanged side edges 238 of trim panels 234 conceal first ridges 138 and fifth ridges 162 of side panels 126. As mentioned previously, first ports 236 of trim panels 234 align with intermediate wide slots 180 of side panels 126 and second ports 237 of trim panels align with upper elongated slots 176 of the second set of first openings 170 of side panels 126. Hinge plate 246 may now be secured to trim panel 234. First, mounting base 244 may be secured to hinge plate 246 as described earlier in this specification and then metal rectangular protrusion 254 of hinge plate 246 is inserted into second port 237 of trim panel 234 and upper elongated slot 176 of side panel 126, thus providing a close fit of rectangular protrusion 254 to second port 237 and upper elongated slot 176. This close fit gives the entire hinge attachment added strength against the possibility of door sag which traditionally appears after prolonged use in traditional wood cabinet hinge mounting applications.

Finally, openings 250 of hinge plate 246 may serve as drill hole locators, allowing drill holes 256 to be drilled into trim panel 234 and side panel 126 in order to further secure hinge plate 246 and mounting base 244 to trim panel 234 and side panel 126 with screws 258. It should be noted that upper elongated slot 176 of side panel 126 accommodates both rectangular-protrusion 256 of hinge plate 246 of door hinge assembly 240 for attachment of doors in a storage cabinet embodiment and upper tab 214 of drawer glide 200 in a lateral file embodiment. A second hinge assembly 240 is similarly installed adjacent the bottom of trim panel 234 into second port 237.

Thus, the use of the box-like inner framework comprised of metal corrugated panels, each having a similar cross sectional configuration and substantially extending the complete depth and length of the case, provides a stronger frame which does not rely on the outer wrapper for its structural integrity. This inner framework construction thereby allows for a reduction in material gauge thickness of steel used for manufacturing each of the metal corrugated panels and the outer wrapper thereby providing a more structurally sound and less expensively produced metal case, which is easily adaptable to varying height metal storage cabinets and lateral files.

Therefore, the invention provides a high quality metal cabinet and lateral file adaptable to various office settings and uses that are attractive, cost effective, sturdy and solid.

We claim:

1. A metal case comprising:

a plurality of vertically oriented corrugated metal side panels, each of said side panels having a top edge and a bottom edge, said side panels having openings therein;

a horizontally oriented corrugated top panel having a first edge and a second edge, said first edge of said top panel attached to said top edge of one of said side panels and said second edge of said top panel attached to said top edge of the other of said side panels;

a horizontally oriented corrugated bottom panel having a first edge and a second edge, said first edge of said bottom panel attached to said bottom edge of one of said side panels and said second edge of said bottom panel attached to said bottom edge of the other of said side panels, said top, bottom and side panels comprising a box-like structure including a front portion and a rear portion;

a metal outer wrapper disposed around said side panels and said rear portion; and a plurality of drawer glides for accommodating drawers in said case, said drawer glides being snapped into and disposed in said openings of said corrugated metal side panels.

2. A metal case according to claim 1 wherein each of said panels has substantially the same cross-sectional configuration.

3. A metal case according to claim 2 wherein said panels include ridges and troughs, said ridges located near the outer edge of each panel and said troughs located between said ridges.

4. A metal case according to claim 3 wherein said openings in said side panels are equidistantly spaced and symmetrically arranged about a vertical centerline along said troughs thereby being symmetrically opposed between each side panel.

5. A metal case according to claim 4 wherein said equidistantly spaced and symmetrically arranged openings include an upper elongated slot and a lower elongated slot located near the outer edge of said trough and an intermediate wide slot located intermediate and offset laterally and inwardly from said upper and lower elongated slots.

6. A metal case according to claim 5 wherein said upper and lower elongated slots may be squatty T-shaped slots, and said intermediate wide slot may be a wide T-shaped slot.

7. A metal case according to claim 6 wherein said drawer glides include tabs and a locking clip symmetrically arranged about a horizontal centerline along said glide for interchangeably snapping said drawer glides into said openings of either of said side panels.

8. A metal case according to claim 7 wherein said tabs include an upper elongated tab and a lower elongated tab located on either side of said horizontal centerline and near one end of said drawer glide and an intermediate tab located about said horizontal centerline and near the other end of said drawer glide.

9. A metal case according to claim 8 wherein said locking clip is located about said horizontal centerline and intermediate laterally and inwardly of said upper and lower elongated tabs on one end of said drawer glide and said intermediate tab on the other end of said drawer glide.

10. A metal case according to claim 9 wherein said upper and lower elongated tabs mate with said upper and lower elongated slots near one end of said side panel, said locking clip mates with said intermediate wide slot near said elongated slots which mate with said elongated tabs and said intermediate tab mates with other said intermediate wide slot located near the other end of said side panel.

11. A metal case comprising:

a set of two vertically disposed side panels, each of said side panels having a top edge and a bottom edge. said side panels including symmetrically arranged openings therein;

a horizontally disposed top panel having a first edge and a second edge, said first and second edges of said top panel being respectively attached to said top edges of said side panels;

a horizontally disposed bottom panel having a first edge and a second edge, said first and second edges of said bottom panel being respectively attached to said bottom edge of said side panels, said top, bottom and side panels comprising a box-like structure having a front portion and a rear portion;

a metal outer wrapper disposed around said side panels and said rear portion; and a plurality of drawer glides for accommodating drawers in said case, said drawer glides being snapped into and disposed in said openings in said side panels.

12. A metal case according to claim 11 wherein said openings of said side panels are equidistantly spaced and symmetrically arranged about a vertical centerline thereby being symmetrically opposed between each side panel.

13. A metal case according to claim 12 wherein said drawer glides include tabs and a locking clip symmetrically arranged about a horizontal centerline along said glide for interchangeably snapping said drawer glides into said openings of either of said side panels.

* * * * *